US011511386B2

(12) United States Patent
Seki et al.

(10) Patent No.: US 11,511,386 B2
(45) Date of Patent: Nov. 29, 2022

(54) POLISHING APPARATUS AND POLISHING METHOD

(71) Applicant: EBARA CORPORATION, Tokyo (JP)

(72) Inventors: Masaya Seki, Tokyo (JP); Masayuki Nakanishi, Tokyo (JP); Makoto Kashiwagi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 805 days.

(21) Appl. No.: 16/513,251

(22) Filed: Jul. 16, 2019

(65) Prior Publication Data

US 2020/0023486 A1 Jan. 23, 2020

(30) Foreign Application Priority Data

Jul. 20, 2018 (JP) ..... JP2018-137067

(51) Int. Cl.

| | |
|---|---|
| ***B24B 21/06*** | (2006.01) |
| ***B24B 21/08*** | (2006.01) |
| ***B24B 21/14*** | (2006.01) |
| ***B24B 21/20*** | (2006.01) |
| ***B24B 21/22*** | (2006.01) |

(Continued)

(52) U.S. Cl.

CPC ..... *B24B 21/002* (2013.01); *B24B 7/228* (2013.01); *B24B 9/065* (2013.01); *B24B 9/102* (2013.01); *B24B 9/107* (2013.01); *B24B 21/06* (2013.01); *B24B 21/08* (2013.01); *B24B 21/14* (2013.01);

(Continued)

(58) Field of Classification Search

CPC ... B24B 21/002; B24B 21/004; B24B 21/008; B24B 21/04; B24B 21/06; B24B 21/08; B24B 21/10; B24B 21/12; B24B 21/14; B24B 21/20; B24B 21/22; B24B 7/228;

(Continued)

(56) References Cited

U.S. PATENT DOCUMENTS 4,266,255 A 5/1981 Camras
6,332,828 B1 * 12/2001 Hasegawa ..... B24B 49/12 451/6

(Continued)

FOREIGN PATENT DOCUMENTS

CN 2512751 Y 9/2002
CN 102152206 A 8/2011

(Continued)

OTHER PUBLICATIONS

European Patent Application No. 19186661.5; Extended Search Report; dated Dec. 2, 2019; 5 pages.

*Primary Examiner* — Eileen P Morgan
(74) *Attorney, Agent, or Firm* — BakerHostetler

(57) ABSTRACT

A polishing apparatus capable of forming a step-shaped recess having a right-angled cross section in an edge portion of a substrate, such as a wafer, is disclosed. The polishing apparatus includes: a substrate rotating device configured to rotate the substrate about a rotation axis; a first roller having a first circumferential surface configured to press a polishing tape against the edge portion of the substrate; and a second roller having a second circumferential surface in contact with the first circumferential surface. The second roller has a tape stopper surface that restricts movement of the polishing tape in a direction away from the rotation axis. The tape stopper surface is located radially outward of the first circumferential surface.

13 Claims, 24 Drawing Sheets

(51) Int. Cl.

| | |
|---|---|
| ***B24B 49/10*** | (2006.01) |
| ***B24B 21/00*** | (2006.01) |
| ***B24B 9/06*** | (2006.01) |
| ***B24B 7/22*** | (2006.01) |
| ***B24B 9/10*** | (2006.01) |
| ***B24C 3/08*** | (2006.01) |

(52) U.S. Cl.
CPC ..... *B24B 21/20* (2013.01); *B24B 21/22* (2013.01); *B24B 49/10* (2013.01); *B24C 3/08* (2013.01)

(58) Field of Classification Search
CPC ..... B24B 9/065; B24B 9/102; B24B 9/107; B24B 49/10; B24B 49/12
USPC ..... 451/9, 10, 11, 44, 303, 307
See application file for complete search history.

(56) References Cited

U.S. PATENT DOCUMENTS

| | | | | |
|---|---|---|---|---|
| 6,402,596 | B1 * | 6/2002 | Hakomori | B24B 9/065 451/306 |
| 8,979,615 | B2 * | 3/2015 | Seki | B24B 21/002 451/303 |
| 9,399,274 | B2 * | 7/2016 | Togawa | B24B 21/06 |
| 9,561,573 | B2 | 2/2017 | Seki et al. | |
| 10,144,103 | B2 | 12/2018 | Seki et al. | |
| 10,343,252 | B2 * | 7/2019 | Togawa | B24B 9/065 |
| 2012/0244787 | A1 * | 9/2012 | Seki | B24B 21/008 451/303 |
| 2014/0087627 | A1 * | 3/2014 | Togawa | B24B 9/065 451/64 |
| 2017/0291273 | A1 * | 10/2017 | Kashiwagi | B24B 9/065 |

FOREIGN PATENT DOCUMENTS

| | | | |
|---|---|---|---|
| CN | 102699794 | A | 10/2012 |
| CN | 103659534 | A | 3/2014 |
| CN | 106029297 | A | 10/2016 |
| CN | 107627186 | A | 1/2018 |
| EP | 2502701 | B1 | 2/2018 |
| JP | H11-203668 | A | 7/1999 |
| JP | 2002-126981 | A | 5/2002 |
| JP | 2012-213849 | A | 11/2012 |
| JP | 2016-219850 | A | 12/2016 |
| JP | 2017-209784 | A | 11/2017 |
| JP | 2018-015841 | A | 2/2018 |
| JP | 2018-020390 | A | 2/2018 |

* cited by examiner

POLISHING APPARATUS AND POLISHING METHOD

CROSS REFERENCE TO RELATED APPLICATION

This document claims priority to Japanese Patent Application Number 2018-137067 filed Jul. 20, 2018, the entire contents of which are hereby incorporated by reference.

BACKGROUND

There is known a polishing apparatus which presses a polishing tape against an edge portion of a wafer to form a step-shaped recess in the edge portion (see, for example, Japanese Laid-Open Patent Publication No. 2012-213849). As shown in FIG. 31, this type of polishing apparatus is configured to press a polishing tape 505 against an edge portion of a wafer W with a pressing member 508 while rotating the wafer W by a wafer stage 500.

FIG. 32 is a top view of the polishing apparatus shown in FIG. 31, and FIG. 33 is a view seen from a direction indicated by arrow A in FIG. 32. The polishing tape 505 contacts the edge portion of the rotating wafer W while advancing at a predetermined speed in a direction indicated by arrows in FIGS. 32 and 33. Liquid (for example, pure water) is supplied to the surface of the wafer W from a liquid supply nozzle (not shown). The polishing tape 505 is placed in sliding contact with the edge portion of the wafer W in the presence of the liquid to form a stepped-shape recess 510 in the edge portion of the wafer W as shown in FIG. 34.

However, as shown in FIG. 32, a length L1 with which the polishing tape 505 is in contact with an outer region of the edge portion of the wafer W is longer than a length L2 with which the polishing tape 505 is in contact with an inner region of the edge portion of the wafer W. This difference in length corresponds to a difference in polishing rate (also referred to as removal rate) between the outer and inner regions of the edge portion. As a result, as shown in FIG. 35, a bottom surface, constituting the recess 510 formed in the edge portion, is inclined with respect to the surface of the wafer W. In addition, an inner edge of the polishing tape 505 in contact with the inclined bottom surface obliquely scrapes off the edge portion of the wafer W. As a result, a vertical surface constituting the recess 510 is inclined.

Further, as shown in FIGS. 36A and 36B, if the pressing member 508 is slightly inclined with respect to the surface of the wafer W when viewed from a radial direction of the wafer W, a polishing-pressure distribution on the edge portion of the wafer W changes significantly. As a result, it becomes difficult to obtain a stable profile of the recess 510.

SUMMARY OF THE INVENTION

According to embodiments, there are provided a polishing apparatus and a polishing method capable of forming a step-shaped recess having a right-angled cross section in an edge portion of a substrate, such as a wafer.

Embodiments, which will be described below, relate to a polishing apparatus and a polishing method for polishing an edge portion of a substrate such as a wafer, and more particularly to a polishing apparatus and a polishing method for forming a step-shaped recess in the edge portion of the substrate by pressing a polishing tape against the edge portion.

In an embodiment, there is provided a polishing apparatus for forming a step-shaped recess in an edge portion of a substrate, comprising: a substrate rotating device configured to rotate the substrate about a rotation axis; a first roller having a first circumferential surface configured to press a polishing tape against the edge portion of the substrate; and a second roller having a second circumferential surface in contact with the first circumferential surface, the second roller having a tape stopper surface that restricts movement of the polishing tape in a direction away from the rotation axis, the tape stopper surface being located radially outward of the first circumferential surface.

In an embodiment, the first roller and the second roller are rotatable about a first axis and a second axis, respectively, extending toward the rotation axis.

In an embodiment, the polishing apparatus further comprises a third roller concentrically fixed to the second roller, the third roller having a third circumferential surface with a diameter smaller than a diameter of the second circumferential surface, the tape stopper surface being connected to the third circumferential surface.

In an embodiment, an axial length of the third roller is smaller than a distance between an inner end surface of the first roller and the tape stopper surface.

In an embodiment, a distance between an inner end surface of the first roller and the tape stopper surface is equal to or smaller than a width of the polishing tape.

In an embodiment, the polishing apparatus further comprises a tape-stopper-surface detection system configured to detect a position of the tape stopper surface.

In an embodiment, the tape-stopper-surface detection system is configured to emit an alarm when an amount of change in the position of the tape stopper surface exceeds a preset threshold value.

In an embodiment, the polishing apparatus further comprises a roller moving mechanism configured to move the first roller and the second roller in a direction toward the rotation axis and in a direction away from the rotation axis, wherein the tape-stopper-surface detection system is configured to instruct the roller moving mechanism to move the first roller and the second roller toward the rotation axis by a distance corresponding to the amount of change in the position of the tape stopper surface.

In an embodiment, the polishing apparatus further comprises: a roller moving mechanism configured to move the first roller and the second roller in a direction toward the rotation axis and in a direction away from the rotation axis; a tape-width measuring sensor configured to measure a width of the polishing tape; and an arithmetic device configured to instruct the roller moving mechanism to move the first roller and the second roller in a direction as to cancel a change in a measured width of the polishing tape.

In an embodiment, there is provided a polishing method of forming a step-shaped recess in an edge portion of a substrate, comprising: rotating the substrate about a rotation axis; and pressing a polishing tape against the edge portion of the substrate by a first circumferential surface of a first roller while restricting movement of the polishing tape in a direction away from the rotation axis by a tape stopper surface of a second roller, the second roller having a second circumferential surface in contact with the first circumferential surface, the tape stopper surface being located radially outward of the first circumferential surface.

In an embodiment, the polishing method further comprises emitting an alarm when an amount of change in a position of the tape stopper surface exceeds a preset threshold value.

In an embodiment, the polishing method further comprises moving the first roller and the second roller toward the rotation axis by a distance corresponding to an amount of change in a position of the tape stopper surface.

In an embodiment, the polishing method further comprises: measuring a width of the polishing tape; and moving the first roller and the second roller in a direction as to cancel a change in a measured width of the polishing tape.

According to the above-described embodiments, the polishing tape is brought into line contact with the edge portion of the substrate. Therefore, the polishing rate is the same over the entirety of the contact surface between the substrate and the polishing tape, and a polishing profile of the substrate is stabilized. Moreover, since the above-described embodiments use the first roller as a pressing member for pressing the polishing tape, unintended concentration of the polishing pressure as shown in FIGS. 36A and 36B does not occur. As a result, the polishing profile of the substrate is stabilized.

DESCRIPTION OF EMBODIMENTS

Embodiments will now be described with reference to the drawings.

Figure 1A:
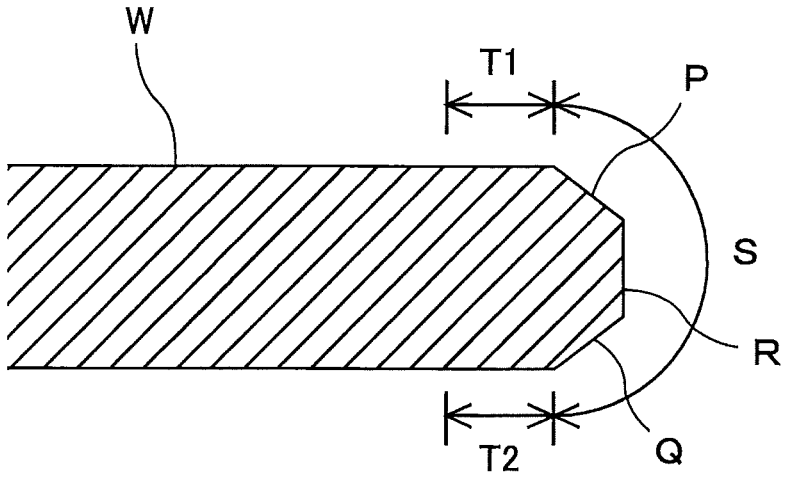
FIG. 1A and FIG. 1B are enlarged cross-sectional views each showing a periphery of a substrate.
Figure 1B:
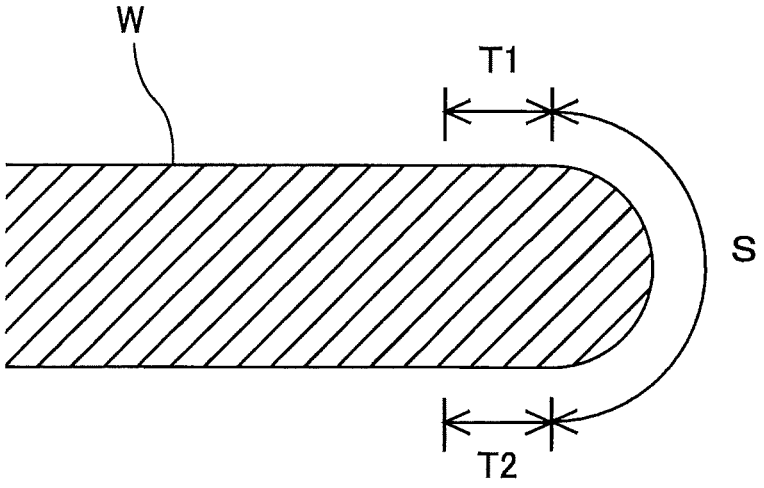

FIG. 1A and FIG. 1B are enlarged cross-sectional views each showing a periphery of a substrate. More specifically, FIG. 1A is a cross-sectional view of a so-called straight-type substrate, and FIG. 1B is a cross-sectional view of a so-called round-type substrate. Examples of the substrate include wafer. The periphery of the substrate is defined as an area including a bevel portion, a top edge portion, and a bottom edge portion. In a wafer W shown in FIG. 1A, the bevel portion is an outermost circumferential surface of the wafer W (indicated by a symbol S) that is constituted by an upper slope portion (an upper bevel portion) P, a lower slope portion (a lower bevel portion) Q, and a side portion (an apex) R. In a wafer W shown in FIG. 1B, the bevel portion is a portion (indicated by a symbol S) having a curved cross section and constituting an outermost circumferential surface of the wafer W. The top edge portion is an annular flat portion T1 located radially inwardly of the bevel portion S. The bottom edge portion is an annular flat portion T2 located opposite the top edge portion and located radially inwardly of the bevel portion S. The top edge portion T1 and the bottom edge portion T2 are connected to the bevel portion S. The top edge portion T1 may include a region where devices are formed. In the following descriptions, the top edge portion T1 and the bottom edge portion T2 may be collectively referred to as edge portions.

Figure 2:
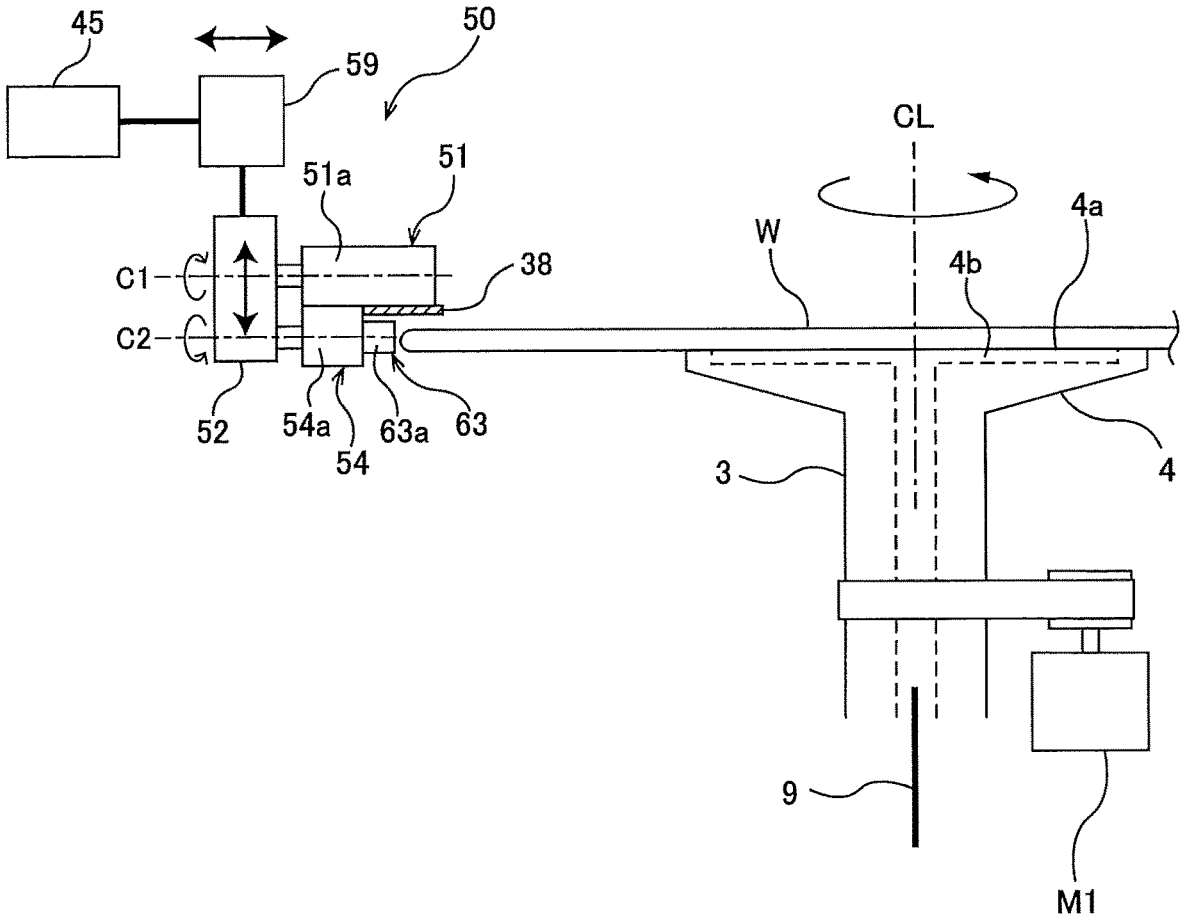
FIG. 2 is a schematic view showing an embodiment of a polishing apparatus.
Figure 3:
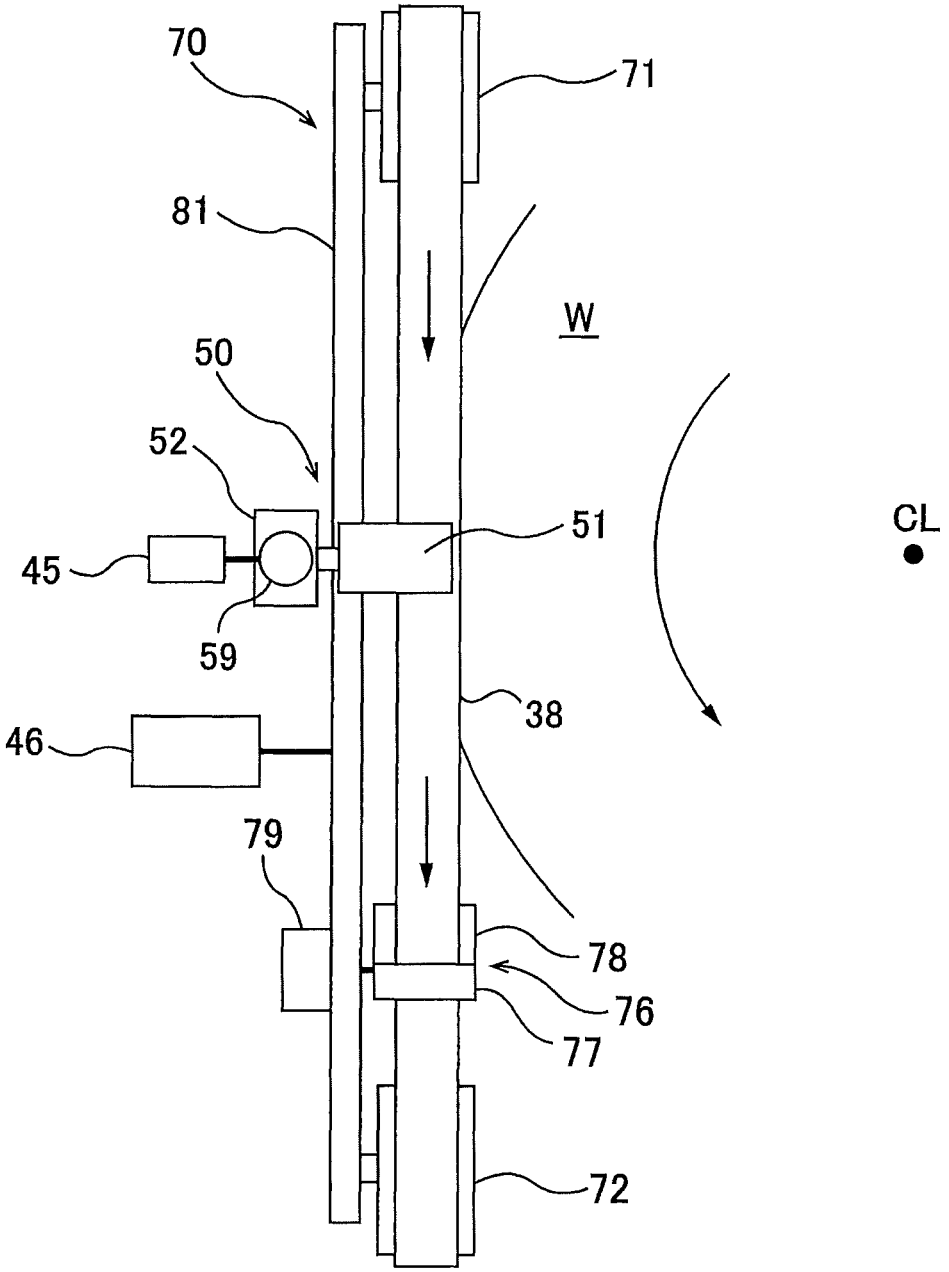
FIG. 3 is a plan view of the polishing apparatus shown in FIG. 2.
Figure 4:
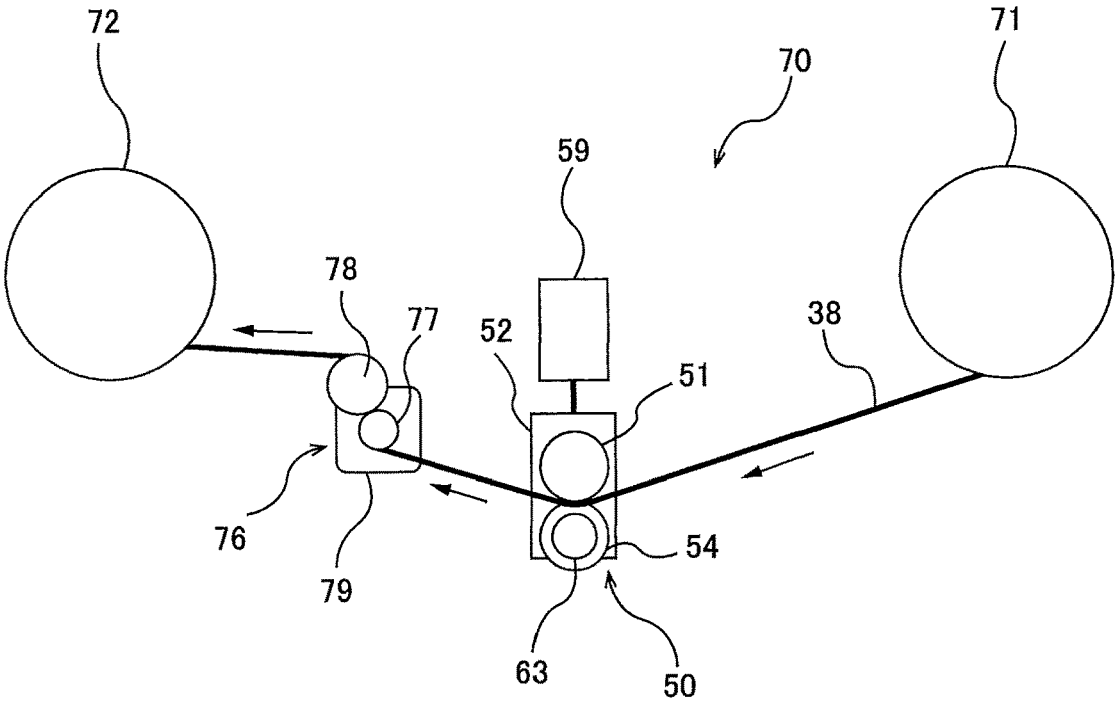
FIG. 4 is a view of the polishing apparatus shown in FIG. 3 as viewed from a wafer side.

FIG. 2 is a schematic view showing an embodiment of a polishing apparatus, FIG. 3 is a plan view of the polishing apparatus shown in FIG. 2, and FIG. 4 is a view of the polishing apparatus shown in FIG. 3 as seen from a wafer side. The polishing apparatus includes a wafer rotating device (substrate rotating device) 3 configured to hold a wafer W (which is an example of a substrate) and rotate the wafer W about a rotation axis CL, a polishing head 50 for polishing an edge portion of the wafer W with a polishing tape 38, and a polishing-tape supply mechanism 70 for supplying the polishing tape 38 to the polishing head 50 and collecting the polishing tape 38 from the polishing head 50.

The wafer rotating device 3 includes a holding stage 4 having a wafer holding surface (or a substrate holding surface) 4*a* for holding a lower surface of the wafer W, and a motor M1 for rotating the holding stage 4 about the rotation axis CL. A groove 4*b* is formed in the wafer holding surface 4*a*, and the groove 4*b* communicates with a vacuum line 9. When a vacuum is produced in the groove 4*b* with the wafer W placed on the wafer holding surface 4*a*, the wafer W is held on the wafer holding surface 4*a* by vacuum suction.

The polishing head 50 includes a first roller 51 having a first circumferential surface 51*a* configured to press the polishing tape 38 against the edge portion of the wafer W, and a second roller 54 having a second circumferential surface 54*a* in contact with the first circumferential surface 51*a*. The first roller 51 and the second roller 54 are configured to be rotatable about a first axis C1 and a second axis C2, respectively, which are parallel to each other. The first axis C1 and the second axis C2 extend toward the rotation axis CL. Specifically, the first axis C1 and the second axis C2 extend in a radial direction of the wafer holding surface 4*a*. The first roller 51 and the second roller 54 are rotatably supported by a roller support member 52.

The polishing head 50 further includes a third roller 63 concentrically fixed to the second roller 54. This third roller 63 has a third circumferential surface 63*a* having a diameter smaller than a diameter of the second circumferential surface 54*a*. The third roller 63 is rotatable together with the second roller 54 about the second axis C2. The polishing head 50 further includes a roller actuator 59 for moving the first roller 51, the second roller 54, and the third roller 63 in a direction perpendicular to the wafer holding surface 4*a* (i.e., in a direction perpendicular to the wafer surface).

The polishing apparatus includes a roller moving mechanism 45 for moving the entire polishing head 50 including the first roller 51, the second roller 54, and the third roller 63 in a direction toward the rotation axis CL and in a direction away from the rotation axis CL. The polishing apparatus further includes a polishing-tape moving mechanism 46 for moving the polishing tape 38 and the polishing-tape supply mechanism 70 in a direction toward the rotation axis CL and in a direction away from the rotation axis CL.

The roller moving mechanism 45 and the polishing-tape moving mechanism 46 are operable independently of each other. Therefore, relative positions of the first roller 51, the second roller 54, and the third roller 63 with respect to the polishing tape 38 can be adjusted by the roller moving mechanism 45 and the polishing-tape moving mechanism 46. Each of the roller actuator 59, the roller moving mechanism 45, and the polishing-tape moving mechanism 46 may be constituted by a combination of air cylinders or a combination of a servomotor and a ball screw.

The polishing-tape supply mechanism 70 includes a feeding reel 71 for feeding the polishing tape 38 and a take-up reel 72 for taking up the polishing tape 38. The feeding reel 71 and the take-up reel 72 are supported by a base 81. A polishing-tape advancing mechanism 76 is provided between the feeding reel 71 and the take-up reel 72. As shown in FIG. 4, the polishing-tape advancing mechanism 76 includes a tape advancing roller 77 for advancing the polishing tape 38, a nip roller 78 for pressing the polishing tape 38 against the tape advancing roller 77, and a tape advancing motor 79 for rotating the tape advancing roller 77. The polishing tape 38 is sandwiched between the nip roller 78 and the tape advancing roller 77. When the tape advancing roller 77 is rotated by the tape advancing motor 79, the polishing tape 38 is advanced at a predetermined speed from the feeding reel 71 to the take-up reel 72 via the polishing head 50.

The polishing tape 38 is supported by the polishing-tape supply mechanism 70 such that a polishing surface of the polishing tape 38 faces the edge portion of the wafer W. One side of the polishing tape 38 constitutes the polishing surface having abrasive grains fixed thereto. The polishing tape 38 is a long polishing tool and extends in a tangential direction of the wafer W. The first roller 51 is a pressing member for pressing the polishing tape 38 against the edge portion of the wafer W, and is arranged above the edge portion of the wafer W. The second roller 54 is provided so as to restrict the movement of the polishing tape 38 in the direction away from the rotation axis CL during polishing of the wafer W.

Figure 34:
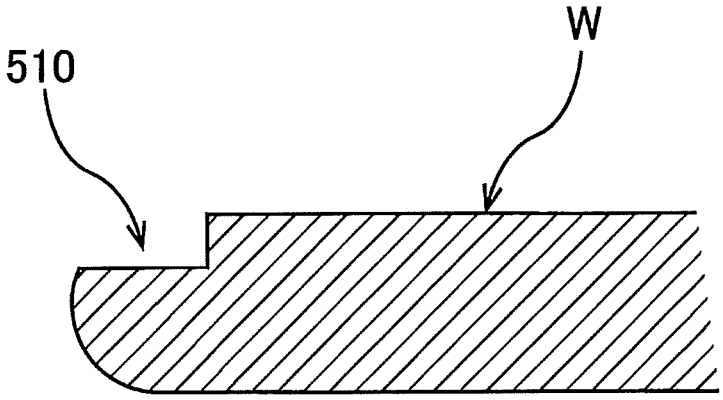
FIG. 34 is a cross-sectional view showing a step-shaped recess formed in an edge portion of a wafer.
Figure 35:
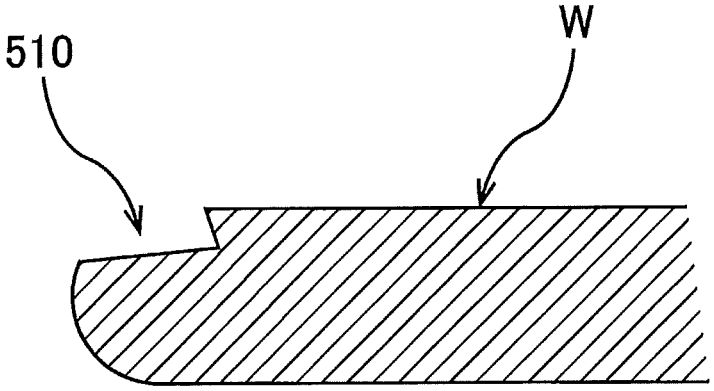
FIG. 35 is a cross-sectional view showing an example of a step-shaped recess formed by the conventional polishing apparatus.

Polishing of the edge portion of the wafer W is performed as follows. As shown in FIG. 2, the lower surface of the wafer W is held by the wafer holding surface 4*a*, and the wafer W is rotated about the rotation axis CL. A liquid (for example, pure water) is supplied onto the center of the upper surface of the wafer W from a nozzle (not shown). The liquid spreads over the entire upper surface of the wafer W by centrifugal force. The roller actuator 59 moves the first roller 51 toward the upper surface of the wafer W to cause the first roller 51 to press the polishing surface of the polishing tape 38 against the edge portion of the wafer W. At this time, the second roller 54 and the third roller 63 are also moved by the roller actuator 59 together with the first roller 51. The polishing surface of the polishing tape 38 is placed in sliding contact with the edge portion of the wafer W in the presence of the liquid, and forms a step-shaped recess 510, as shown in FIG. 34, in the edge portion of the wafer W. During the polishing of the edge portion of the wafer W, the polishing tape 38 is advanced at a predetermined speed by the polishing-tape advancing mechanism 76.

Figure 5:
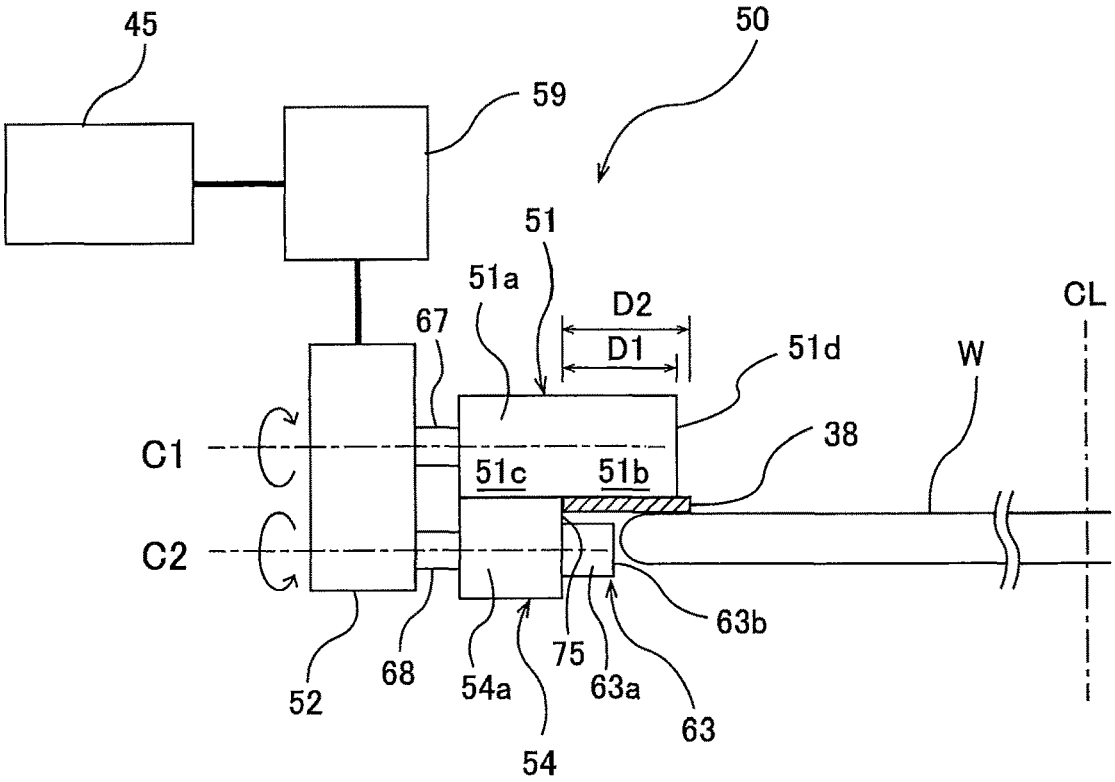
FIG. 5 is an enlarged view of a polishing head having a first roller, a second roller, and a third roller.
Figure 6:
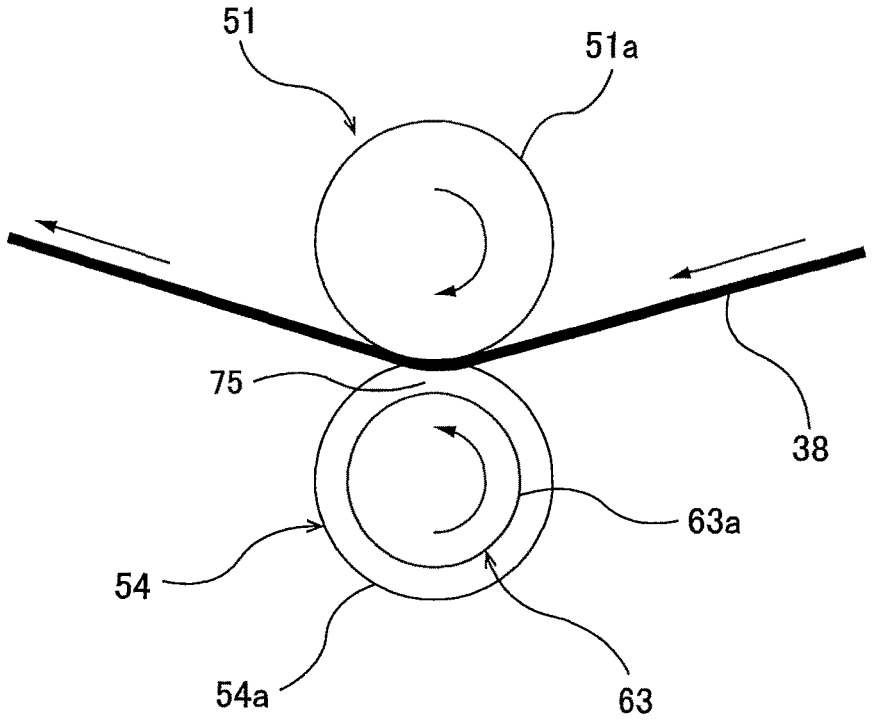
FIG. 6 is an axial view of the first roller, the second roller, and the third roller.

FIG. 5 is an enlarged view of the polishing head 50 having the first roller 51, the second roller 54, and the third roller 63, and FIG. 6 is a view showing the first roller 51, the second roller 54, and the third roller 63 as viewed from an axial direction. The first circumferential surface 51*a* of the first roller 51 has an inner region 51*b* which is not in contact with the second circumferential surface 54*a* of the second roller 54, and an outer region 51*c* which is in contact with the second circumferential surface 54*a* of the second roller 54. The inner region 51*b* is located inwardly of the outer region 51*c* in the radial direction of the wafer holding surface 4*a* (see FIG. 2). The inner region 51*b* and the outer region 51*c* are both cylindrical in shape. The back side of the polishing tape 38 is supported by the inner region 51*b* of the first circumferential surface 51*a* of the first roller 51. The second roller 54 is located beneath the first roller 51. The second circumferential surface 54*a* of the second roller 54 is in contact with a lower portion of the first circumferential surface 51*a* of the first roller 51, i.e., a lower portion of the outer region 51*c*. The third roller 63 is located below the inner region 51*b* of the first circumferential surface 51*a*.

The first roller 51 is supported by a first support shaft 67, which is supported by the roller support member 52. The second roller 54 and the third roller 63 are supported by a second support shaft 68, which is supported by the roller support member 52. In the present embodiment, the first support shaft 67 and the second support shaft 68 are rotatably supported by bearings (not shown) disposed in the roller support member 52. The first roller 51 is fixed to the first support shaft 67, and the second roller 54 and the third roller 63 are fixed to the second support shaft 68. In one embodiment, the first support shaft 67 and the second support shaft 68 may be fixed to the roller support member 52, the first roller 51 may be rotatably supported by a bearing (not shown) disposed in the first roller 51, and the second roller 54 and the third roller 63 may be rotatably supported by a bearing (not shown) disposed in the second roller 54.

The second roller 54 has a tape stopper surface 75 which restricts the movement of the polishing tape 38 in the direction away from the rotation axis CL. The tape stopper surface 75 is composed of an inner end surface of the second roller 54. The inner end surface of the second roller 54 is an end surface of the second roller 54 that faces toward the rotation axis CL. The tape stopper surface 75 is connected to the third circumferential surface 63*a* of the third roller 63. As shown in FIG. 6, in the present embodiment, the tape stopper surface 75 is annular. The tape stopper surface 75 is located between the first circumferential surface 51*a* and the third circumferential surface 63*a*. The tape stopper surface 75 is located radially outward of the first circumferential surface 51*a*.

A distance D1 between an inner end surface 51*d* of the first roller 51 and the tape stopper surface 75 (the distance being along the axial direction of the first roller 51) is smaller than a width D2 of the polishing tape 38. Therefore, the inner edge of the polishing tape 38 protrudes from the inner end surface 51*d* of the first roller 51 toward the rotation axis CL. The inner end surface 51*d* of the first roller 51 is an end surface of the first roller 51 that faces toward the rotation axis CL. In one embodiment, the distance D1 between the inner end surface 51*d* of the first roller 51 and the tape stopper surface 75 may be the same as the width D2 of the polishing tape 38. In this case, the inner edge of the polishing tape 38 coincides with the inner end surface 51*d* of the first roller 51.

The feeding reel 71 and the take-up reel 72 are located slightly outward of the tape stopper surface 75 in the radial direction of the wafer holding surface 4*a*. Therefore, during polishing of the wafer W, an outer edge of the polishing tape 38 is pressed against the tape stopper surface 75 by the tension of the polishing tape 38, whereby the positioning of the polishing tape 38 is achieved. During polishing of the wafer W, the outward movement of the polishing tape 38 in the radial direction of the wafer holding surface 4*a* is restricted by the tape stopper surface 75. The inner edge and the outer edge of the polishing tape 38 are both side edges of the polishing tape 38 along its longitudinal direction. The inner edge is located inwardly of the outer edge in the radial direction of the wafer holding surface 4*a* (see FIG. 2).

An axial length of the third roller 63 is smaller than the distance D1 between the inner end surface 51*d* of the first roller 51 and the tape stopper surface 75. An inner end surface 63*b* of the third roller 63 is located between the inner end surface 51*d* of the first roller 51 and the tape stopper surface 75 in the axial direction of the first roller 51. With such a configuration, the first circumferential surface 51*a* of the first roller 51 can press the polishing surface of the polishing tape 38 against the edge portion of the wafer W. The inner end surface 63*b* of the third roller 63 is an end surface of the third roller 63 facing toward the rotation axis CL.

During the polishing of the wafer W, the polishing tape 38 is advanced at a predetermined speed in the longitudinal direction of the polishing tape 38. When the polishing tape 38 is advanced, the first roller 51 rotates about the first axis C1 due to frictional resistance acting between the back side of the polishing tape 38 and the first circumferential surface 51*a* of the first roller 51. Since the second circumferential surface 54*a* of the second roller 54 is in contact with the first circumferential surface 51*a* of the first roller 51, the second roller 54 rotates in the opposite direction about the second axis C2 as the first roller 51 rotates. In the present embodiment, the diameter of the second circumferential surface 54*a* of the second roller 54 is the same as the diameter of the first circumferential surface 51*a* of the first roller 51. Therefore, the second roller 54 rotates in the opposite direction at the same rotational speed as that of the first roller 51. In one embodiment, the diameter of the second circumferential surface 54*a* of the second roller 54 may be different from the diameter of the first circumferential surface 51*a* of the first roller 51.

The third roller 63 is located radially outward of the first circumferential surface 51*a* of the first roller 51. The third roller 63 is provided so as to prevent undulation (wrinkling deformation) of the polishing tape 38 during polishing of the wafer W. A difference between a radius of the second circumferential surface 54*a* and a radius of the third circumferential surface 63*a* is larger than a thickness of the polishing tape 38. In other words, a gap formed between the first circumferential surface 51*a* of the first roller 51 and the third circumferential surface 63*a* of the third roller 63 is larger than the thickness of the polishing tape 38. Therefore, when the back side of the polishing tape 38 is supported by the first circumferential surface 51*a* of the first roller 51, the polishing surface of the polishing tape 38 is not in contact with the third circumferential surface 63*a* of the third roller 63.

The first roller 51 has a cylindrical shape. In the present embodiment, the axial length of the first roller 51 is longer than the diameter of the first roller 51, while, in one embodiment, the axial length of the first roller 51 may be shorter than the diameter of the first roller 51. The polishing tape 38, when pressed by the cylindrical first roller 51, is placed in line contact with the edge portion of the wafer W. Specifically, the polishing surface of the polishing tape 38 contacts the edge portion of the wafer W with the same width along the radial direction of the wafer W. Therefore, polishing rates of the wafer W in the inner region and the outer region of the edge portion of the wafer W are substantially the same. As a result, the polishing tape 38 can form a step-shaped recess 510 having a right-angled cross section as shown in FIG. 34 in the edge portion of the wafer W. The bottom surface of the step-shaped recess 510 shown in FIG. 34 is parallel to the upper surface of the wafer W, and the vertical surface of the step-shaped recess 510 is perpendicular to the upper surface of the wafer W.

Figure 36A:
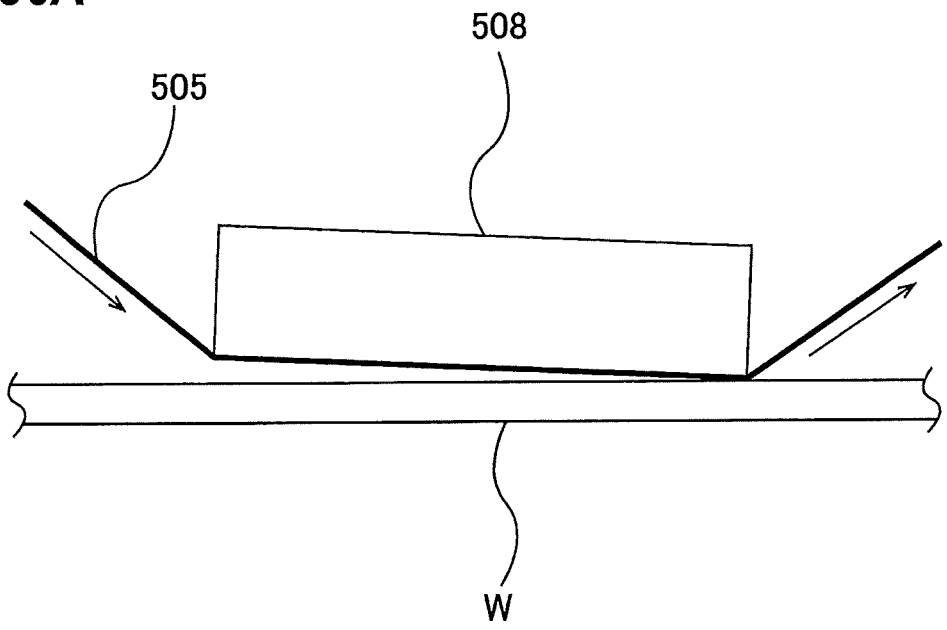
FIG. 36A and FIG. 36B are cross-sectional views each showing a state in which a polishing tape is pressed against a wafer by a pressing member of the conventional polishing apparatus.
Figure 36B:
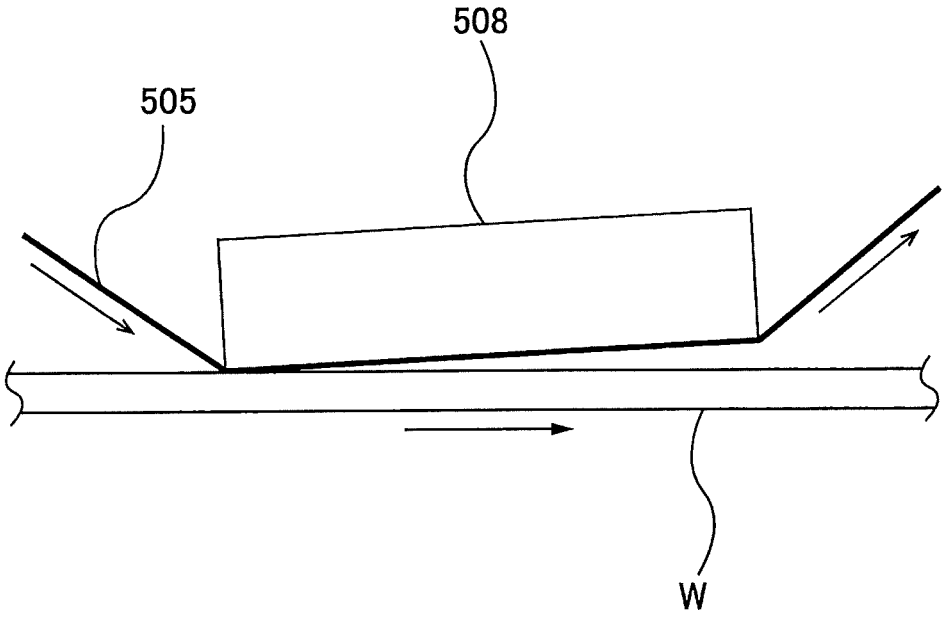

According to the present embodiment, the polishing rates are the same over the entire contact surface between the wafer W and the polishing tape 38. As a result, a polishing profile of the wafer W is stabilized. Furthermore, in the present embodiment using the first roller 51 as a pressing member for pressing the polishing tape, unintended concentration of the polishing pressure as shown in FIGS. 36A and 36B does not occur. As a result, the polishing profile of the wafer W is stabilized.

The first circumferential surface 51*a* of the first roller 51 is in rolling contact with the back side of the polishing tape 38, and the polishing tape 38 does not substantially slide on the first circumferential surface 51*a*. Therefore, the polishing tape 38 can be smoothly advanced in its longitudinal direction. In addition, wear of the first roller 51 can be suppressed, and frequency of replacing the first roller 51 can be reduced. Similarly, the tape stopper surface 75 rotates in the same direction as the advancing direction of the polishing tape 38, and therefore wear of the tape stopper surface 75 is suppressed. As a result, frequency of replacing the second roller 54 can be reduced. Since the third roller 63 does not contact the polishing surface of the polishing tape 38, the third circumferential surface 63*a* basically does not wear. However, if the polishing tape 38 deforms in a wrinkle shape, the polishing surface of the polishing tape 38 may contact the third circumferential surface 63*a*. Even in such a case, since the third circumferential surface 63*a* rotates in the same direction as the advancing direction of the polishing tape 38, wear of the third circumferential surface 63*a* is suppressed.

Materials which constitute the first roller 51, the second roller 54, and the third roller 63 are not limited particularly. In one embodiment, the first roller 51 is made of a resin such as polyetheretherketone (PEEK), a metal such as stainless steel, or a ceramic such as SiC (silicon carbide). The second roller 54 and the third roller 63 may be made of resin such as polyetheretherketone (PEEK).

Figure 7:
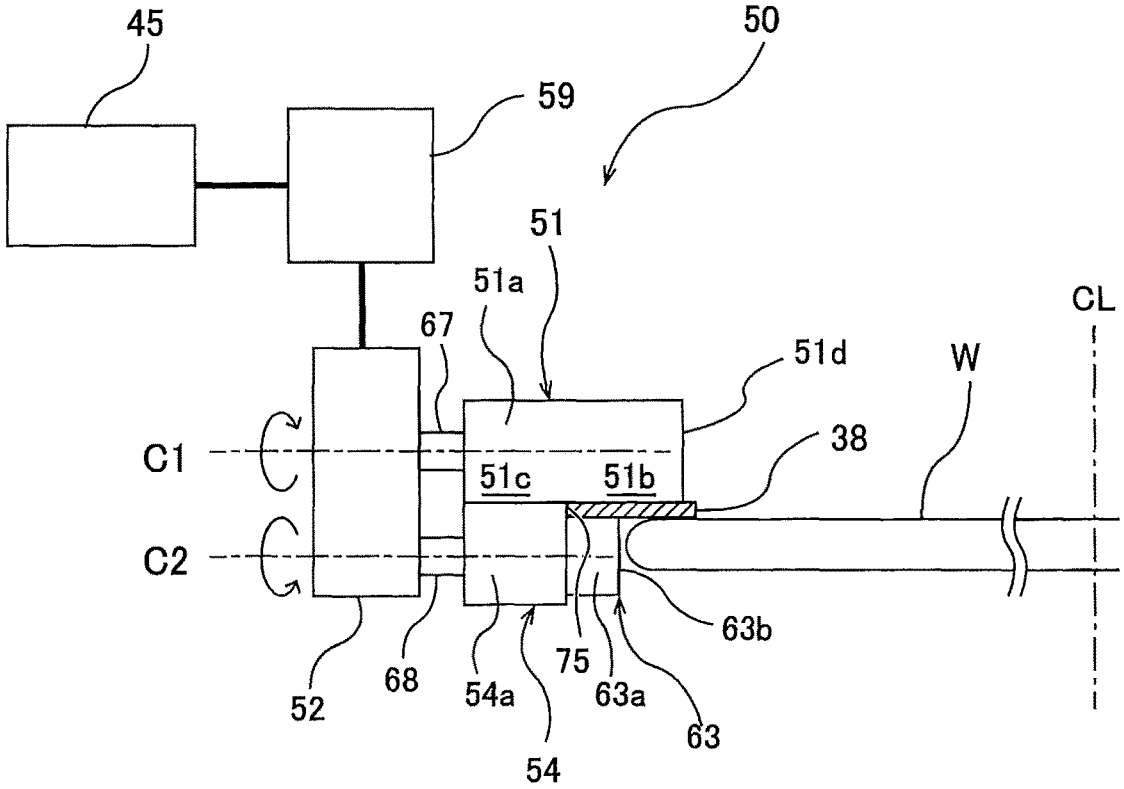
FIG. 7 is a schematic view showing an embodiment in which a third circumferential surface of the third roller is made of an elastic material such as rubber.

In an embodiment shown in FIG. 7, the third circumferential surface 63*a* of the third roller 63 may be made of an elastic material, such as rubber. In the embodiment shown in FIG. 7, the second circumferential surface 54*a* of the second roller 54 is in contact with the first circumferential surface 51*a* of the first roller 51, and the third circumferential surface 63*a* of the third roller 63 is in contact with the polishing surface of the polishing tape 38. An outer portion of the polishing tape 38 is sandwiched between the first roller 51 and the third roller 63, so that undulation (wrinkling deformation) of the polishing tape 38 is prevented during polishing of the wafer W. Furthermore, it is possible to prevent slip between the first circumferential surface 51*a* of the first roller 51 and the back side of the polishing tape 38.

Figure 8:
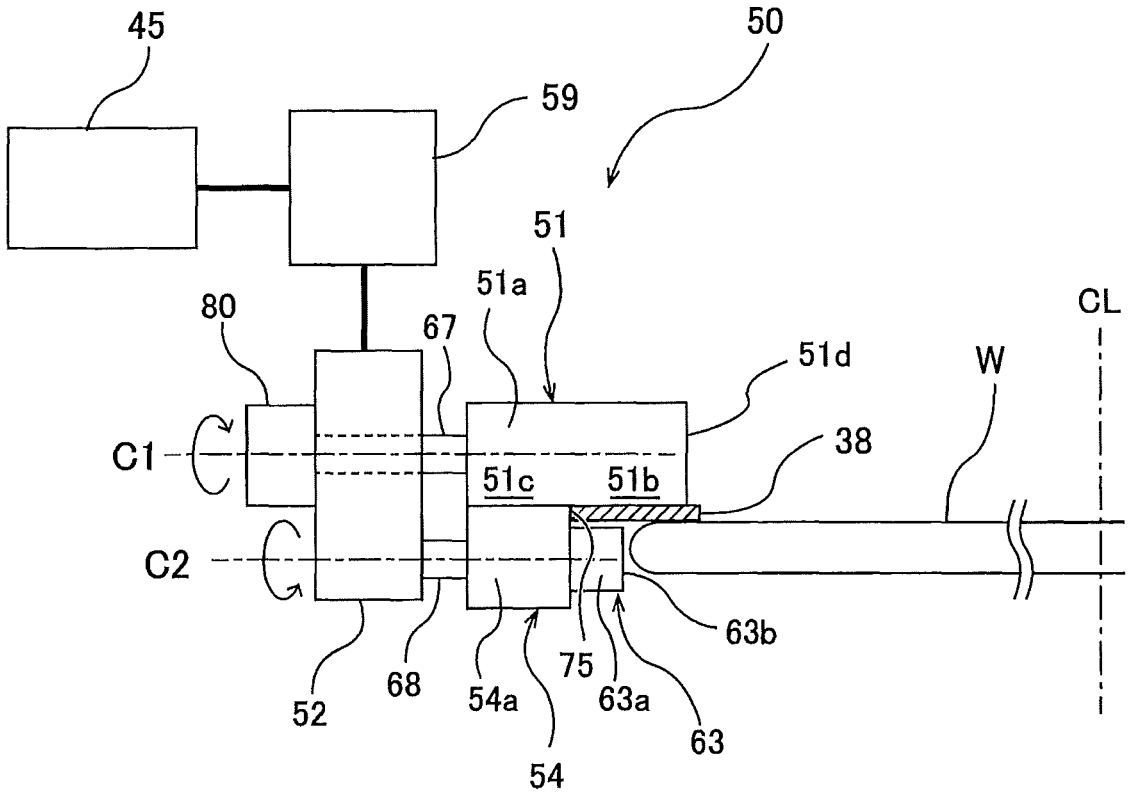
FIG. 8 is a schematic view showing an embodiment of the polishing head having the first roller coupled to a servomotor.

As shown in FIG. 8, the polishing head 50 may further includes a servomotor 80 for rotating the first roller 51 in synchronization with the advancing speed of the polishing tape 38. The servomotor 80 is fixed to the roller support member 52 and coupled to the first support shaft 67. The first support shaft 67 is rotatably supported by a bearing (not shown) disposed in the roller support member 52. When the first roller 51 is rotated by the servomotor 80, the second roller 54 in contact with the first circumferential surface 51*a* of the first roller 51 rotates in the opposite direction. In one embodiment, the servomotor 80 may be coupled to the second support shaft 68 supporting the second roller 54, instead of the first support shaft 67 supporting the first roller 51. In this case, when the second roller 54 is rotated by the servomotor 80, the first roller 51 in contact with the second circumferential surface 54*a* of the second roller 54 rotates in the opposite direction.

The outer edge of the polishing tape 38 is in contact with the tape stopper surface 75. As discussed previously, since the tape stopper surface 75 moves in the same direction as the advancing direction of the polishing tape 38 during polishing of the wafer W, the tape stopper surface 75 is less likely to wear. However, since the abrasive grains are slightly attached to the outer edge of the polishing tape 38, it is not possible to completely prevent the wear of the tape stopper surface 75. When the wear of the tape stopper surface 75 progresses, the polishing tape 38 cannot form a step-shaped recess at an intended position in the edge portion of the wafer W.

Figure 9:
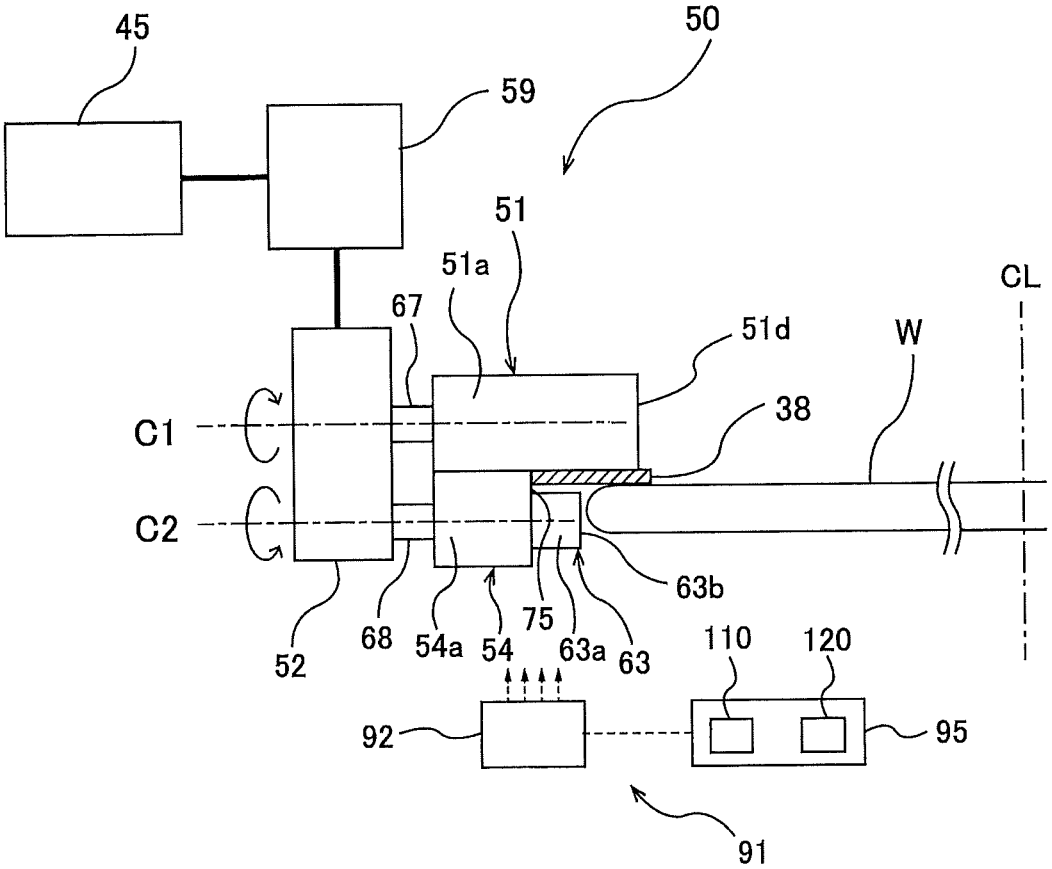
FIG. 9 is a schematic view showing an embodiment of the polishing apparatus including a tape-stopper-surface detection system.

Thus, in one embodiment described next, as shown in FIG. 9, the polishing apparatus further includes a tape-stopper-surface detection system 91 for detecting a position of the tape stopper surface 75. The tape-stopper-surface detection system 91 is configured to detect the position of the tape stopper surface 75 in the axial direction of the second roller 54. More specifically, the tape-stopper-surface detection system 91 includes a distance sensor 92 configured to measure distances from a reference surface to the second roller 54 and the third roller 63, and an arithmetic device 95 configured to determine the position of the tape stopper surface 75 from measurement data of the distances.

In this embodiment, the distance sensor 92 is configured to measure the distances from the reference surface to the second circumferential surface 54*a* of the second roller 54 and the third circumferential surface 63*a* of the third roller 63 at a multiple number of measurement points arranged on a straight line. The reference surface is, for example, a front surface of the distance sensor 92. The distance sensor 92 may be a line scan distance sensor or a line scan displacement sensor capable of measuring a surface profile of an object. Sensors of this type are commercially available.

Figure 10:
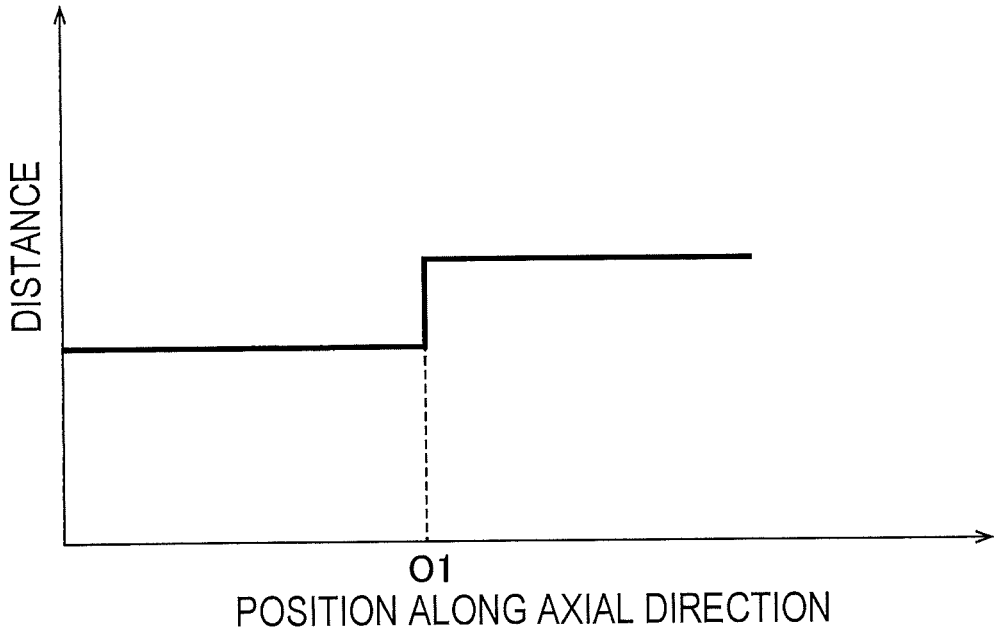
FIG. 10 is a graph representing distances measured by a distance sensor.

FIG. 10 is a graph representing the distances measured by the distance sensor 92. In FIG. 10, a vertical axis represents distance from the reference surface, and a horizontal axis represents position along the axial direction of the second roller 54 and the third roller 63. A symbol O1 shown in FIG. 10 indicates a position of the tape stopper surface 75. As the tape stopper surface 75 wears, the position of the tape stopper surface 75 indicated by the symbol O1 changes.

The distance sensor 92 is electrically connected to the arithmetic device 95, and the distance sensor 92 is configured to send the measurement data of the distances to the arithmetic device 95. The arithmetic device 95 includes a memory 110 for storing the measurement data of the distances and a program described below, and further includes a processing device (such as CPU) 120 for executing the program. The arithmetic device 95 may be composed of a general-purpose computer or a dedicated computer.

The program stored in the memory 110 is configured to cause the arithmetic device 95 to execute a step of determining an initial position and a current position of the tape stopper surface 75 from the measurement data of the distances from the reference surface to the second roller 54 and the third roller 63, a step of calculating a difference between the initial position and the current position of the tape stopper surface 75, and a step of generating an alarm signal when the calculated difference exceeds a preset threshold value.

The difference between the initial position and the current position of the tape stopper surface 75 is an amount of change in the position of the tape stopper surface 75, which corresponds to an amount of wear of the tape stopper surface 75. The arithmetic device 95 is configured to emit an alarm when the difference between the initial position and the current position of the stopper surface 75 (i.e., the amount of change in the position of the tape stopper surface 75)

exceeds the preset threshold value. By such an operation, a user can know from the alarm that the tape stopper surface 75 has worn beyond an allowable level.

In one embodiment, the program is configured to cause the arithmetic device 95 to execute a step of determining an initial position and a current position of the tape stopper surface 75 from the measurement data of the distances from the reference surface to the second roller 54 and the third roller 63, a step of calculating a difference between the initial position and the current position of the tape stopper surface 75, and a step of instructing the roller moving mechanism 45 to move the polishing head 50, including the first roller 51, the second roller 54, and the third roller 63, toward the rotation axis CL by a distance corresponding to the above difference.

The arithmetic device 95 instructs the roller moving mechanism 45 to move the polishing head 50 toward the rotation axis CL by a distance corresponds to the difference between the initial position and the current position of the tape stopper surface 75 (i.e., the amount of change in the position of tape stopper surface 75). By such operation, the tape stopper surface 75 and the polishing tape 38 are returned to their initial positions.

The position of the tape stopper surface 75 in the axial direction of the second roller 54 is an axial position of the tape stopper surface 75 relative to the distance sensor 92. Therefore, in order to correctly determine the amount of wear of the tape stopper surface 75, a relative position between the polishing head 50 and the distance sensor 92 when detecting the position of the tape stopper surface 75 needs to be always constant. From such a point of view, in one embodiment, the distance sensor 92 is coupled to the polishing head 50 and is movable together with the second roller 54 and the third roller 63. For example, the distance sensor 92 is fixed to the roller support member 52 directly or through a mounting member (not shown).

Figure 11:
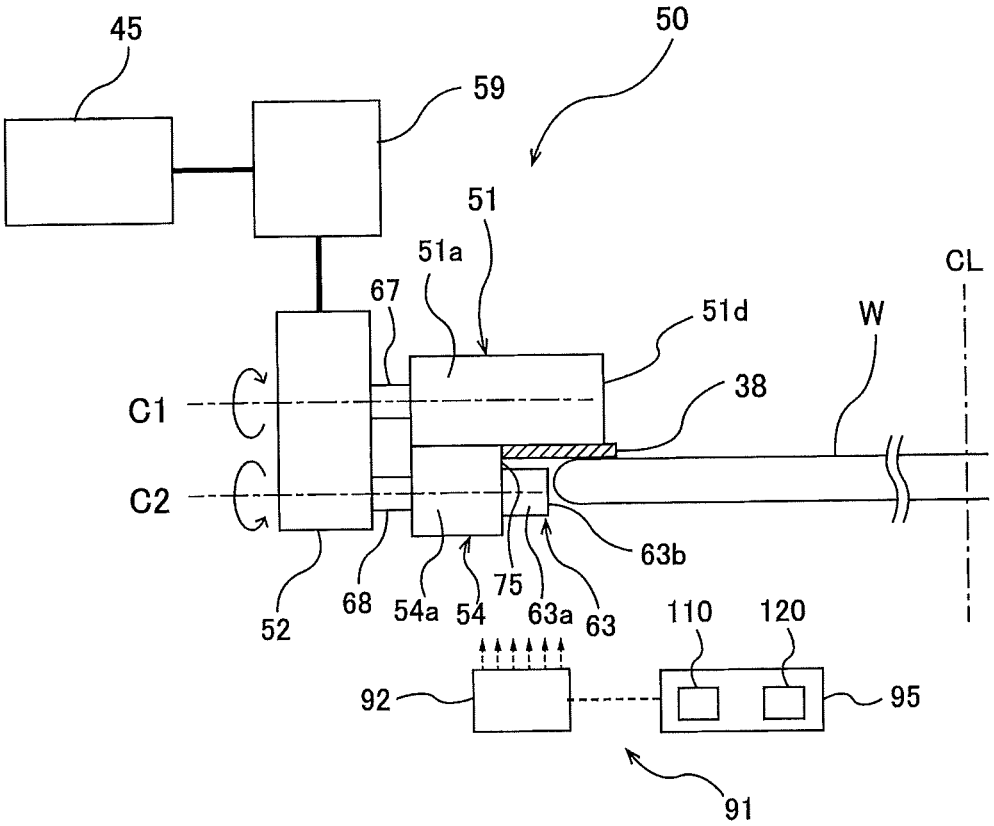
FIG. 11 is a schematic view showing another embodiment of the polishing apparatus including the tape-stopper-surface detection system.

FIG. 11 is a schematic view showing another embodiment of the tape-stopper-surface detection system 91. Configuration and operation of this embodiment, which will not be particularly described, are the same as those of the embodiment shown in FIG. 9, and their repetitive descriptions will be omitted. In this embodiment, the distance sensor 92 is arranged so as to measure distances from the reference surface to the second roller 54 and the third roller 63 in a measurement target region including at least a region from the tape stopper surface 75 to the inner end surface 63*b* of the third roller 63.

Figure 12:
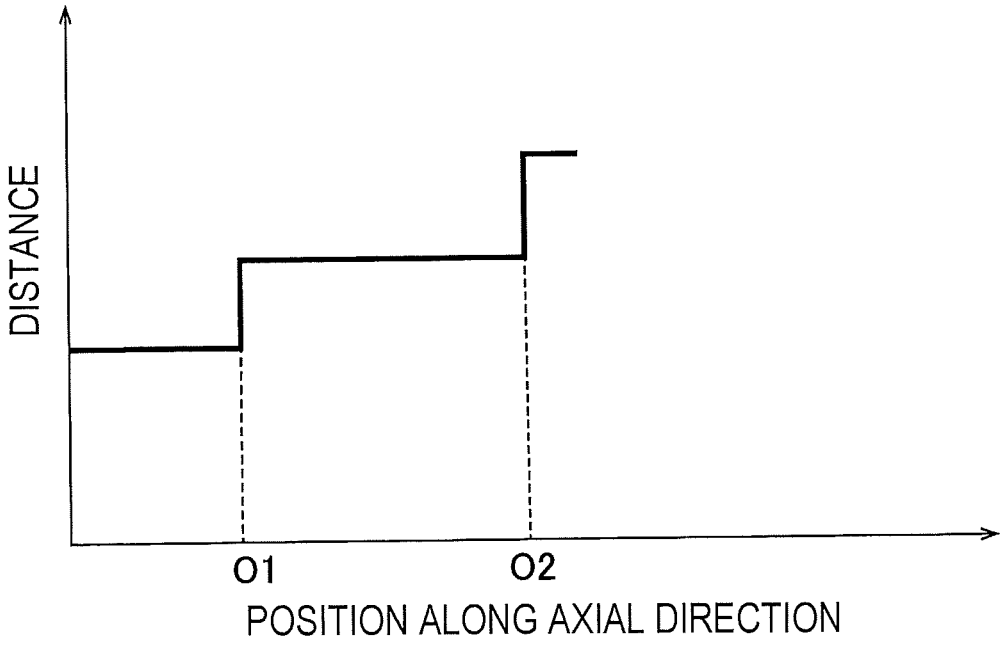
FIG. 12 is a graph representing distances measured by a distance sensor.

FIG. 12 is a graph representing the distances measured by the distance sensor 92. In FIG. 12, a vertical axis represents distance from the reference surface, and a horizontal axis represents position along the axial direction of the second roller 54 and the third roller 63. Symbol O1 shown in FIG. 12 indicates the position of the tape stopper surface 75, and symbol O2 indicates the position of the inner end surface 63*b* of the third roller 63.

The inner end surface 63*b* of the third roller 63 does not wear because it does not contact the polishing tape 38, while the tape stopper surface 75 gradually wears because it contacts the outer edge of the polishing tape 38. Therefore, the amount of change in the position of the tape stopper surface 75, i.e., the amount of wear of the tape stopper surface 75, corresponds to an amount of change in a distance from the inner end surface 63*b* of the third roller 63 indicated by the symbol O2 to the tape stopper surface 75 indicated by the symbol O1.

The program stored in the memory 110 is configured to cause the arithmetic device 95 to execute a step of determining the position O2 of the inner end surface 63*b* of the third roller 63 and the position O1 of the tape stopper surface 75 from the measurement data of the distances from the reference surface to the second roller 54 and the third roller 63, a step of calculating an initial value and a current value of a distance from the inner end surface 63*b* of the third roller 63 to the tape stopper surface 75, a step of calculating a difference between the current value and the initial value of the distance, and a step of generating an alarm signal when the calculated difference exceeds a preset threshold value.

The difference between the current value and the initial value of the distance from the inner end surface 63*b* of the third roller 63 to the tape stopper surface 75 is the amount of change in the position of the tape stopper surface 75, which corresponds to the amount of wear of the tape stopper surface 75. The arithmetic device 95 is configured to emit an alarm when the difference between the current value and the initial value of the distance (i.e., the amount of change in the position of the tape stopper surface 75) exceeds the preset threshold value. By such an operation, a user can know from the alarm that the tape stopper surface 75 has worn beyond an allowable level.

In one embodiment, the program is configured to cause the arithmetic device 95 to execute a step of determining the position O2 of the inner end surface 63*b* of the third roller 63 and the position O1 of the tape stopper surface 75 from the measurement data of the distances from the reference surface to the second roller 54 and the third roller 63, a step of calculating an initial value and a current value of a distance from the inner end surface 63*b* of the third roller 63 to the tape stopper surface 75, a step of calculating a difference between the current value and the initial value of the distance, and a step of instructing the roller moving mechanism 45 to move the polishing head 50 including the first roller 51, the second roller 54, and the third roller 63 toward the rotation axis CL by a distance corresponding to the above difference.

The arithmetic device 95 instructs the roller moving mechanism 45 to move the polishing head 50 toward the rotation axis CL by the distance corresponds to the difference between the initial value and the current value of the distance from the inner end surface 63*b* of the third roller 63 to the tape stopper surface 75 (i.e., by the distance corresponding to the amount of change in the position of the tape stopper surface 75). By such operation, the tape stopper surface 75 and the polishing tape 38 are returned to their initial positions.

In the present embodiment, the distance between the inner end surface 63*b* of the third roller 63 and the tape stopper surface 75 is used for detecting the amount of wear of the tape stopper surface 75. In other words, the relative position of the tape stopper surface 75 with respect to the inner end surface 63*b* of the third roller 63 is used for detecting the amount of wear of the tape stopper surface 75. Therefore, the relative position between the distance sensor 92 and the polishing head 50 does not have to be constant. The distance sensor 92 may be installed at a base (not shown) or the like of the polishing apparatus, or may be coupled to the polishing head 50 as with the embodiment shown in FIG. 9.

In both of the embodiments shown in FIGS. 9 and 11, the detection of the axial position of the tape stopper surface 75 by the tape-stopper-surface detection system 91 is performed when the wafer W is not being polished. For example, the detection of the axial position of the tape stopper surface 75 is performed before the polishing of the wafer W or after the polishing of the wafer W. The reason for this is to avoid an adverse effect on the detection of the tape stopper surface 75 due to the liquid supplied to the wafer W.

A movable sensor cover (not shown) may be disposed above the distance sensor 92 in order to prevent the liquid, supplied to the wafer W, from contacting the distance sensor 92. The movable sensor cover may be located above the distance sensor 92 during polishing of the wafer W, and may be moved away from the position above the distance sensor 92 when wear of the tape stopper surface 75 is to be detected.

If the liquid supplied to the wafer W adheres to the second roller 54 and the third roller 63, the tape stopper surface 75 may not be detected correctly. Therefore, the polishing apparatus may include an air blower (not shown) for removing the liquid from the second roller 54 and the third roller 63.

Figure 13:
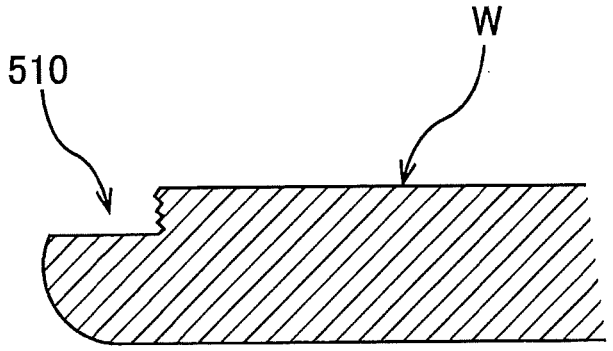
FIG. 13 is a cross-sectional view showing a recess formed in an edge portion of a wafer.

The width of the polishing tape 38 is not completely constant over the entire length of the polishing tape 38, and varies slightly from part to part of the polishing tape 38. Since the polishing tape 38 is advanced at a predetermined speed during polishing of the wafer W, the vertical surface of the recess 510 formed in the edge portion of the wafer W may become rough due to the variation in width of the polishing tape 38, as shown in FIG. 13.

Figure 14:
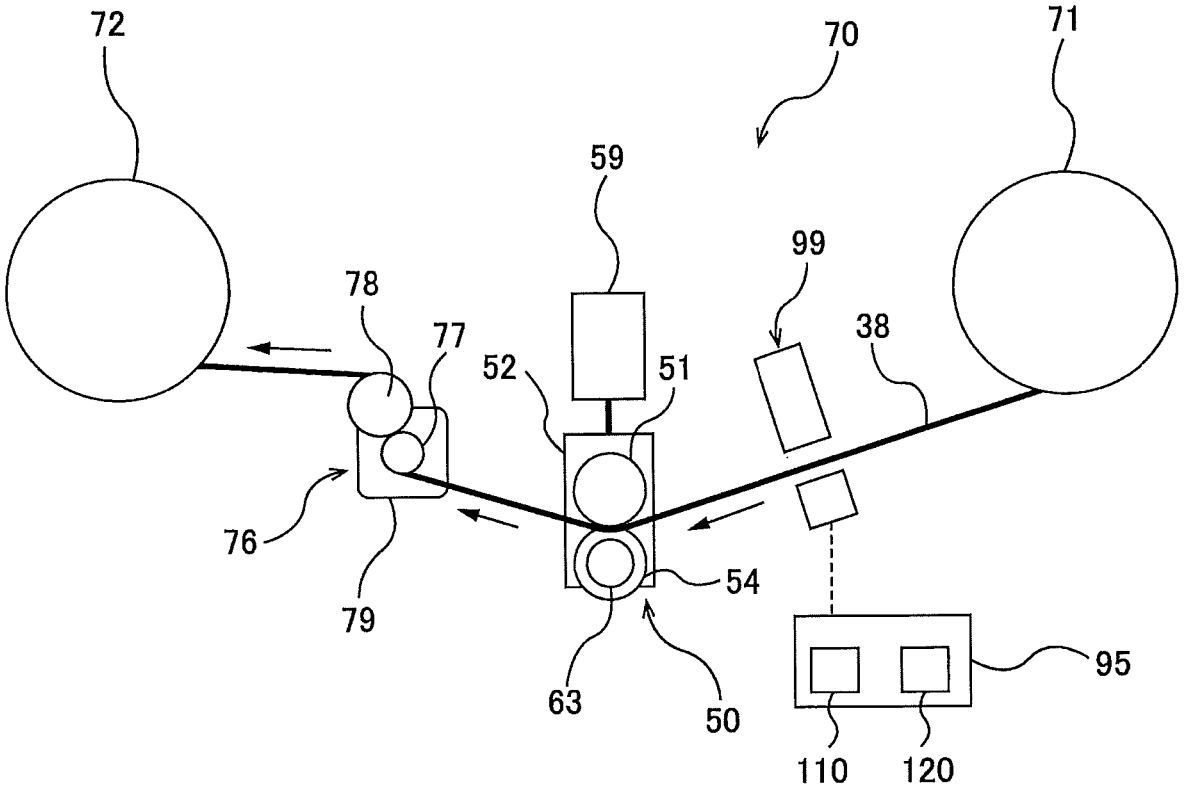
FIG. 14 is a schematic view showing an embodiment of the polishing apparatus including a tape-width measuring sensor.

Thus, in an embodiment described next, as shown in FIG. 14, a tape-width measuring sensor 99 is provided so as to measure the width of the polishing tape 38 before being sent to the first roller 51. Configuration and operation of this embodiment, which will not be described particularly, are the same as those of the above-described embodiment, and thus repetitive descriptions will be omitted.

In the present embodiment, the polishing head 50 is moved in the direction toward the rotation axis CL (see FIG. 2) or in the direction away from the rotation axis CL based on a measured value of the width of the polishing tape 38 such that a position of the inner edge of the polishing tape 38 is kept constant. The tape-width measuring sensor 99 may be a transmission laser sensor capable of measuring a dimension of an object. Sensors of this type are commercially available.

Figure 15:
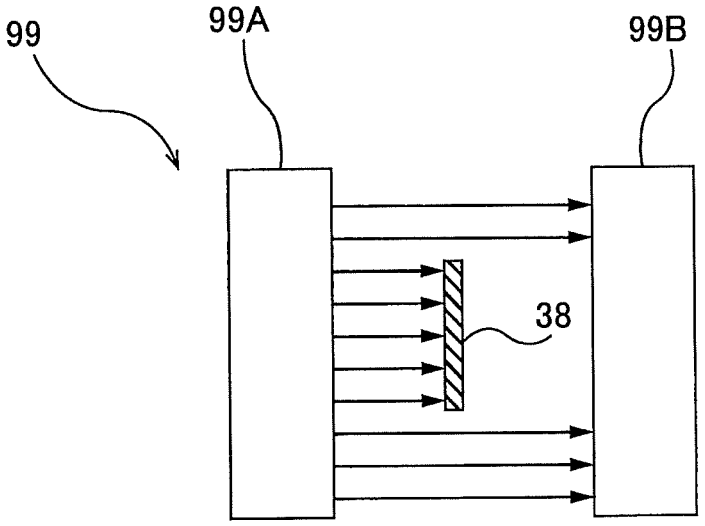
FIG. 15 is a schematic view showing a transmission type laser sensor.

FIG. 15 is a schematic view showing the tape-width measuring sensor 99 constituted by the transmission laser sensor. The tape-width measuring sensor 99 includes a light emitting device 99A configured to emit a laser beam, and a light receiving device 99B configured to receive the laser beam. The light emitting device 99A and the light receiving device 99B are arranged so as to face both sides of the polishing tape 38. Specifically, the polishing tape 38, which is an object to be measured, is located between the light emitting device 99A and the light receiving device 99B. A part of the laser beam emitted from the light emitting device 99A is blocked by the polishing tape 38, and the light receiving device 99B measures a length at which the laser beam is blocked. The length at which the laser beam is blocked corresponds to the width of the polishing tape 38.

As shown in FIG. 14, the tape-width measuring sensor 99 is located upstream of the first roller 51 in the advancing direction of the polishing tape 38. The tape-width measuring sensor 99 is fixed to the polishing-tape supply mechanism 70. The tape-width measuring sensor 99 is electrically connected to the arithmetic device 95. The tape-width measuring sensor 99 measures the width of the polishing tape 38 before the polishing tape 38 is advanced to the first roller 51, and sends measurement data of the width of the polishing tape 38 to the arithmetic device 95.

The arithmetic device 95 may be composed of at least one computer. The arithmetic device 95 includes the memory 110 that stores the measurement data of the width of the polishing tape 38 and a program described below, and the processing device (such as CPU) 120 for executing the program. The program is configured to cause the arithmetic device 95 to execute a step of calculating a difference between the measured width of the polishing tape 38 and a reference width, and a step of instructing the roller moving mechanism 45 (see FIGS. 2 and 3) immediately before a measured part of the polishing tape 38, whose width has been measured, reaches the first roller 51 to move the polishing head 50 including the first roller 51, the second roller 54 and the third roller 63 toward or away from the rotation axis CL by a distance corresponding to the above difference to thereby cancel the change in the width of the polishing tape 38.

The above reference width of the polishing tape 38 may be a preset value or may be a width of the polishing tape 38 measured first. An estimated time for the measured part of the polishing tape 38 to reach the first roller 51 can be calculated from the advancing speed of the polishing tape 38 and a distance from the tape-width measuring sensor 99 to the first roller 51 along the polishing tape 38.

According to this embodiment, the first roller 51, the second roller 54, and the third roller 63 are moved in the direction as to cancel the change in the width of the polishing tape 38. As a result, the position of the inner edge of the polishing tape 38 is always kept constant. Therefore, the polishing tape 38 can form a recess having a smooth vertical surface as shown in FIG. 34 in the edge portion of the wafer W.

In one embodiment, the arithmetic device 95 may be configured to instruct the polishing-tape moving mechanism 46 to move the polishing-tape supply mechanism 70 in the direction toward or away from the rotation axis CL by a distance corresponding to the difference between the measured width of the polishing tape 38 and the reference width when the roller moving mechanism 45 moves the polishing head 50. The reason for this is to prevent excessive deformation of the polishing tape 38 by keeping a constant relative position between the polishing head 50 and the polishing-tape supply mechanism 70 when the wafer W is being polished.

Figure 16:
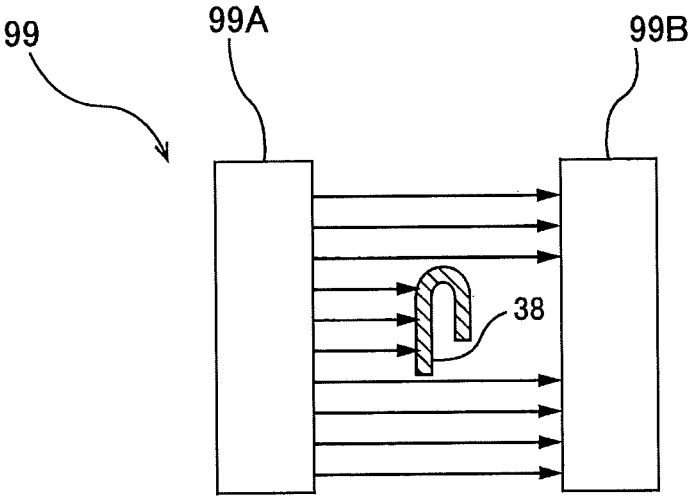
FIG. 16 is a view showing an example in which a polishing tape, passing through the tape-width measuring sensor, is bent along a longitudinal direction of the polishing tape.

As shown in FIG. 16, when the polishing tape 38 is bent along its longitudinal direction, the measured width of the polishing tape 38 becomes smaller than a normal range. Therefore, when the measured width of the polishing tape 38 is less than a preset lower limit value, the arithmetic device 95 may generate an alarm signal or may emit an alarm.

Figure 17:
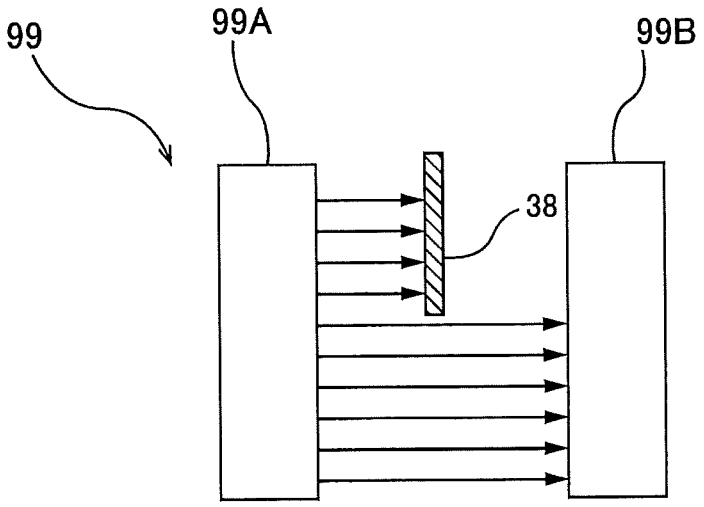
FIG. 17 is a view showing an example in which the polishing tape, passing through the tape-width measuring sensor, is deviated from a normal position.
Figure 18:
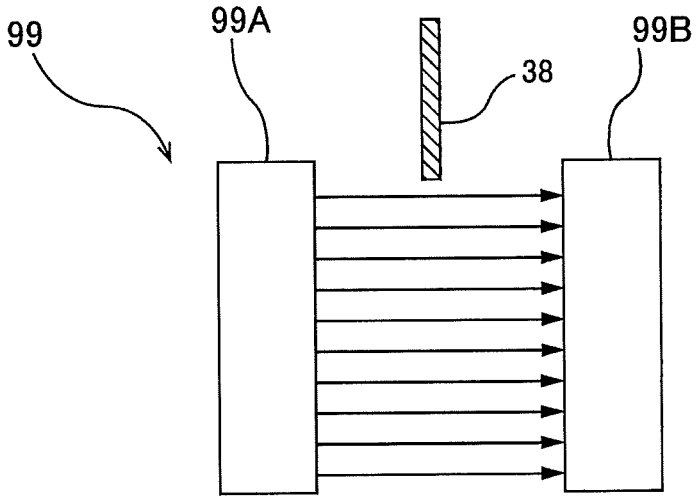
FIG. 18 is a view showing an example in which the entirety of the polishing tape is out of a normal range.

Further, when the polishing tape 38 is deviated from a normal position as shown in FIG. 17 and when the entire polishing tape 38 is out of a normal range as shown in FIG. 18, the polishing tape 38 cannot form a recess at an intended position in the edge portion of the wafer W. Thus, the arithmetic device 95 may generate an alarm signal or may emit an alarm when the position of the entire polishing tape 38 is out of a set range.

The embodiments described above can be combined as appropriate. For example, the tape-stopper-surface detection system 91 shown in FIG. 9 or FIG. 11 may be combined with the embodiments described with reference to FIG. 14 to FIG. 18.

Figure 19:
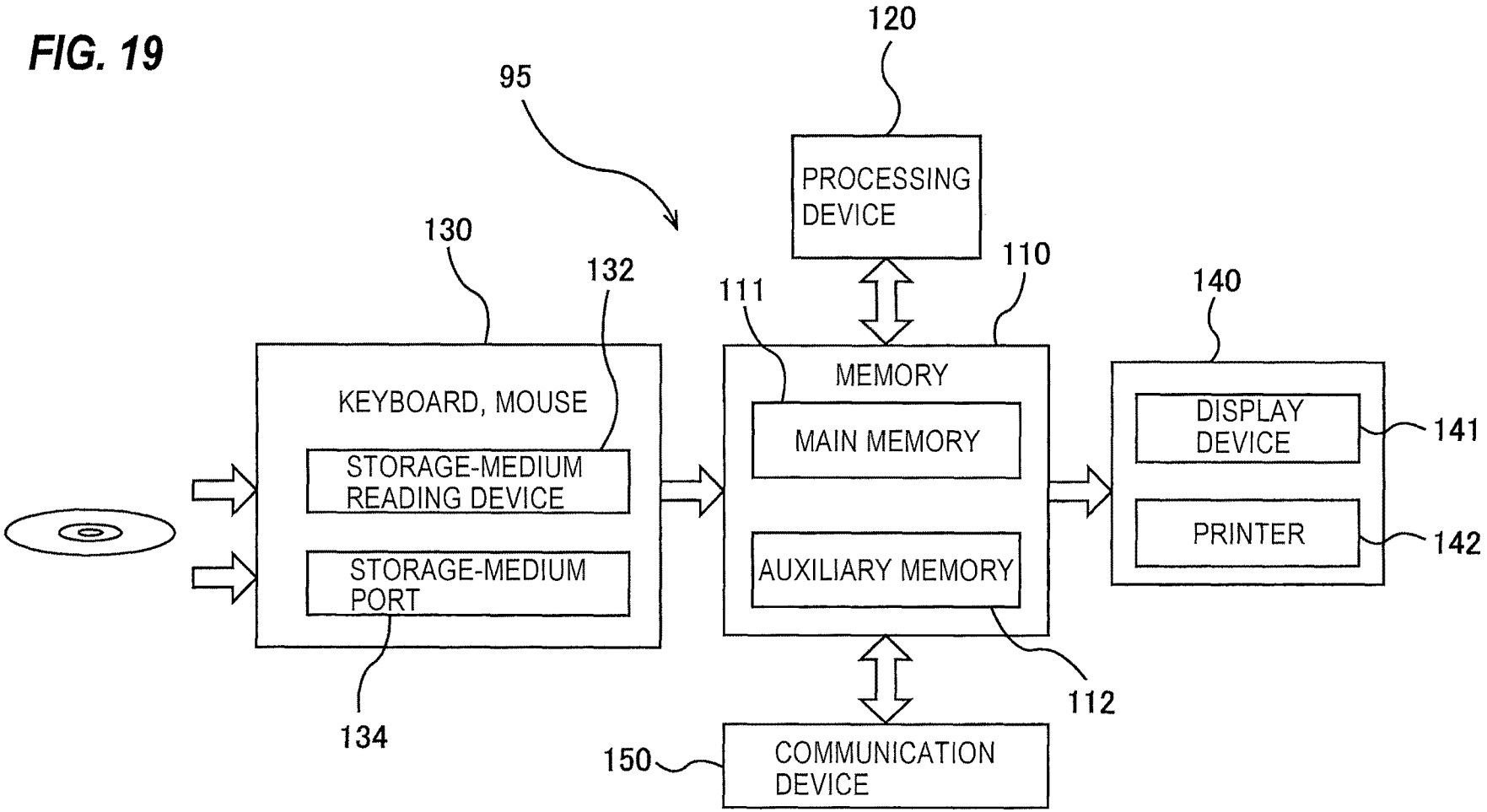
FIG. 19 is a schematic view showing a configuration of an arithmetic device.

FIG. 19 is a schematic view showing an embodiment of the arithmetic device 95 used in each of the above-described embodiments. The arithmetic device 95 may be a dedicated computer or a general-purpose computer. For example, the arithmetic device 95 may be a PLC (programmable logic controller). The arithmetic device 95 includes the memory 110 in which the program and data are stored, the processing device 120, such as CPU (central processing unit), for performing arithmetic operation according to instructions contained in the program stored in the memory 110, an input device 130 for inputting the data, the program, and various information into the memory 110, an output device 140 for outputting processing results and processed data, and a communication device 150 for connecting to a network, such as the Internet.

The memory 110 includes a main memory 111 which is accessible by the processing device 120, and an auxiliary memory 112 that stores the data and the program therein. The main memory 111 may be a random-access memory (RAM), and the auxiliary memory 112 is a storage device which may be a hard disk drive (HDD) or a solid-state drive (SSD).

The input device 130 includes a keyboard and a mouse, and further includes a storage-medium reading device 132 for reading the data from a storage medium, and a storage-medium port 134 to which a storage medium can be connected. The storage medium is a non-transitory tangible computer-readable storage medium. Examples of the storage medium include optical disk (e.g., CD-ROM, DVD-ROM) and semiconductor memory (e.g., USB flash drive, memory card). Examples of the storage-medium reading device 132 include optical drive (e.g., CD-ROM drive, DVD-ROM drive) and memory reader. Examples of the storage-medium port 134 include USB port. The program and/or the data electrically stored in the storage medium is introduced into the arithmetic device 95 via the input device 130, and is stored in the auxiliary memory 112 of the memory 110. The output device 140 includes a display device 141 and a printer 142.

The arithmetic device 95 operates according to the instructions contained in the program electrically stored in the memory 110. The program for causing the arithmetic device 95 to perform the steps described in the above embodiments is stored in a non-transitory tangible computer-readable storage medium, and the arithmetic device 95 is provided with the program via the storage medium. The arithmetic device 95 may be provided with the program via communication network, such as the Internet.

Figure 20:
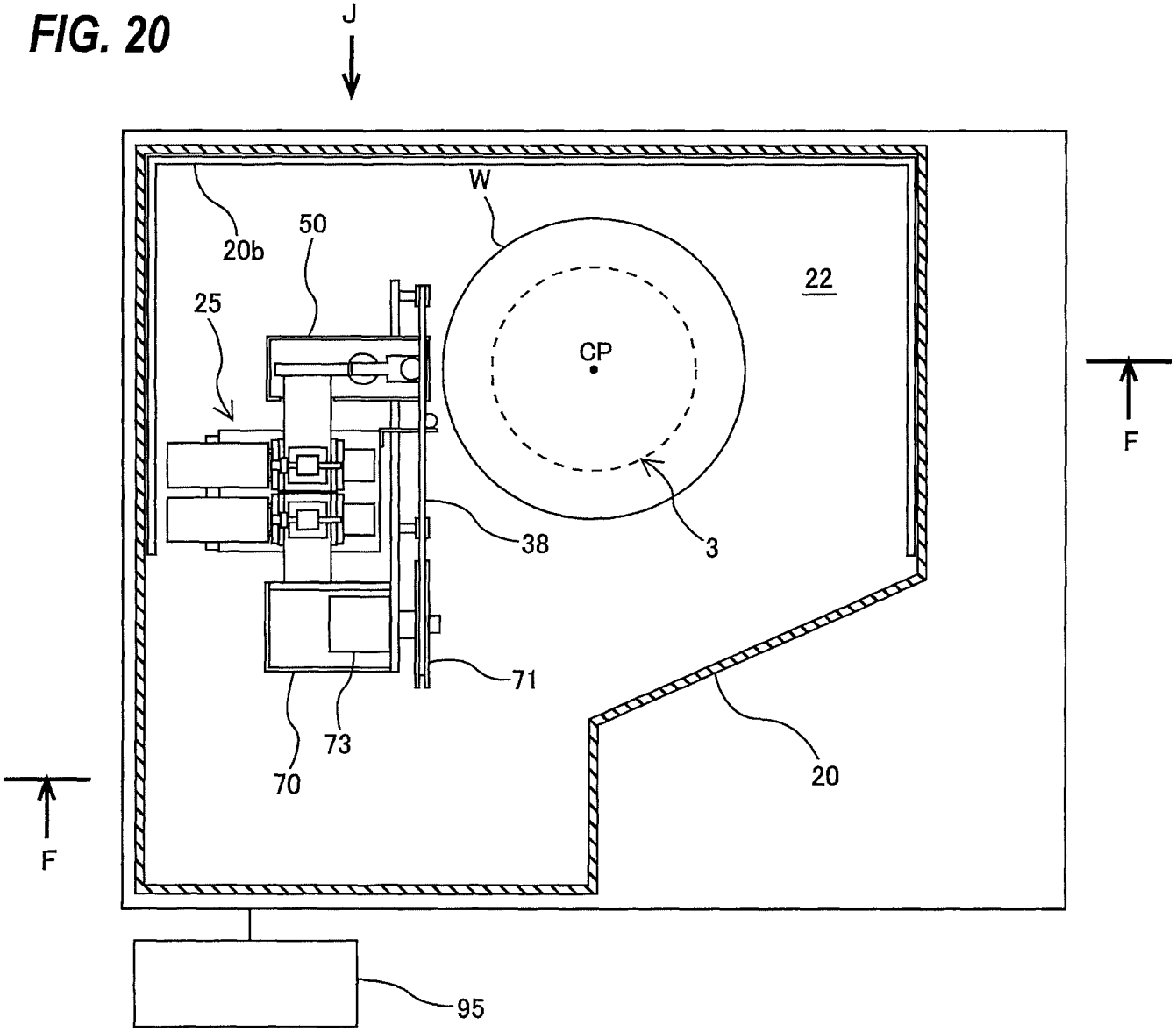
FIG. 20 is a plan view showing an embodiment of the detailed configuration of the polishing apparatus.

Next, the details of the polishing apparatus will be described. FIG. 20 is a plan view showing an embodiment of a detailed configuration of the polishing apparatus, FIG. 21 is a cross-sectional view taken along line F-F in FIG. 20, and FIG. 22 is a view from a direction indicated by arrow G in FIG. 21.

The polishing apparatus according to the embodiment includes the wafer rotating device (substrate rotating device) 3 configured to hold a wafer W, which is an example of a substrate, and rotate the wafer W, and further includes a polishing unit 25 configured to polish the wafer W on the wafer rotating device 3. FIGS. 20 and 21 show a state in which the wafer rotating device 3 holds the wafer W. This wafer rotating device 3 has the holding stage 4 having the wafer holding surface (substrate holding surface) 4*a* configured to hold a lower surface of the wafer W by the vacuum suction, a hollow shaft 5 coupled to a central portion of the holding stage 4, and the motor M1 for rotating the hollow shaft 5. The wafer W is placed onto the wafer holding surface 4*a* of the holding stage 4 such that the center of the wafer W is aligned with the rotation axis CP of the hollow shaft 5.

As shown in FIG. 20, the polishing unit 25 includes the polishing head 50 for polishing the edge portion of the wafer W using the polishing tape 38 that serves as a polishing tool, and the polishing-tape supply mechanism 70 for supplying the polishing tape 38 to the polishing head 50 and collecting the polishing tape 38 from the polishing head 50. The polishing head 50 is configured to form a step-shaped recess in the edge portion of the wafer W by pressing the polishing surface of the polishing tape 38 against the edge portion of the wafer W. The polishing unit 25 and the holding stage 4 are located in a polishing chamber 22 formed by a partition wall 20.

Figure 21:
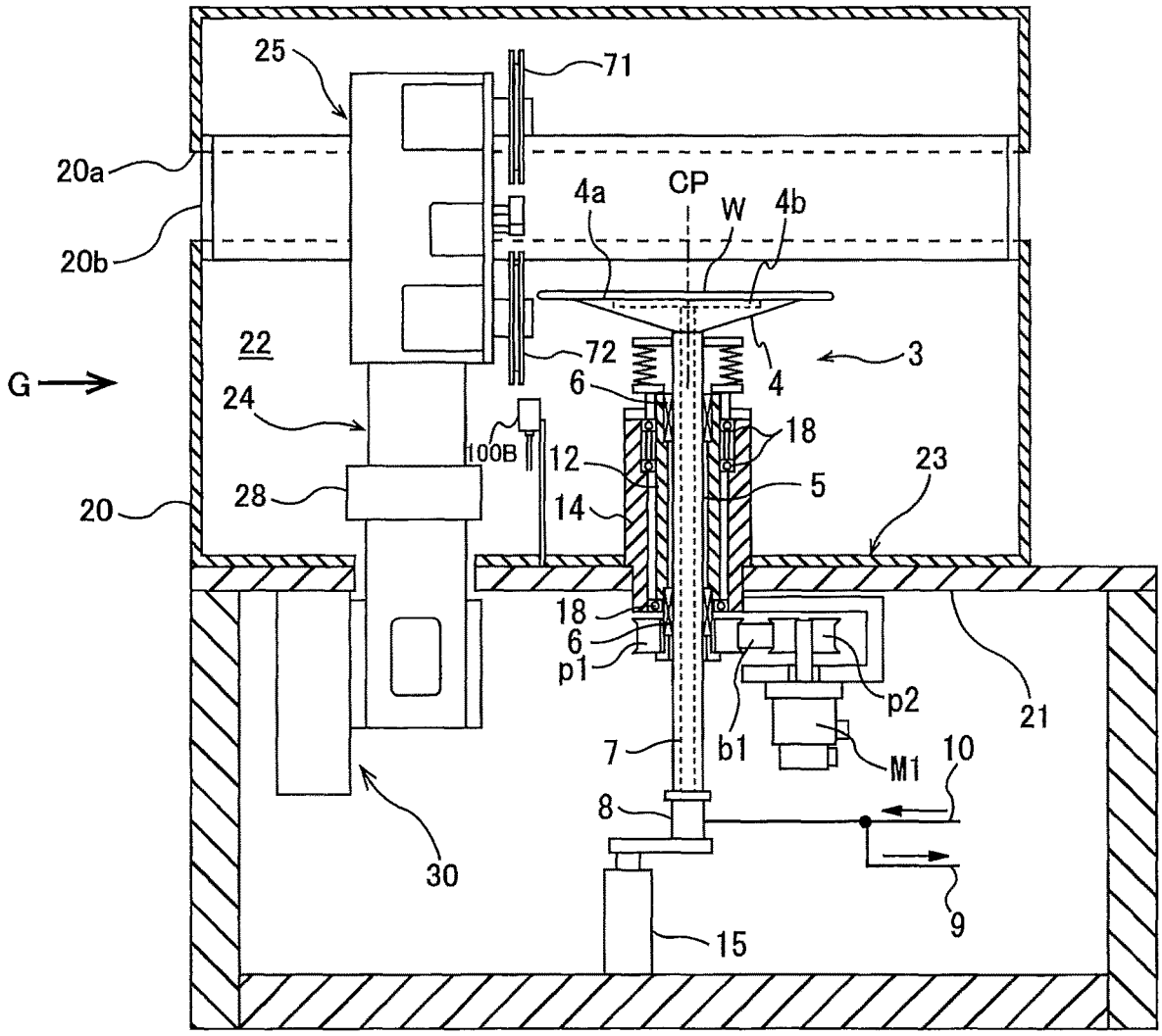
FIG. 21 is a cross-sectional view taken along line F-F of FIG. 20.
Figure 22:
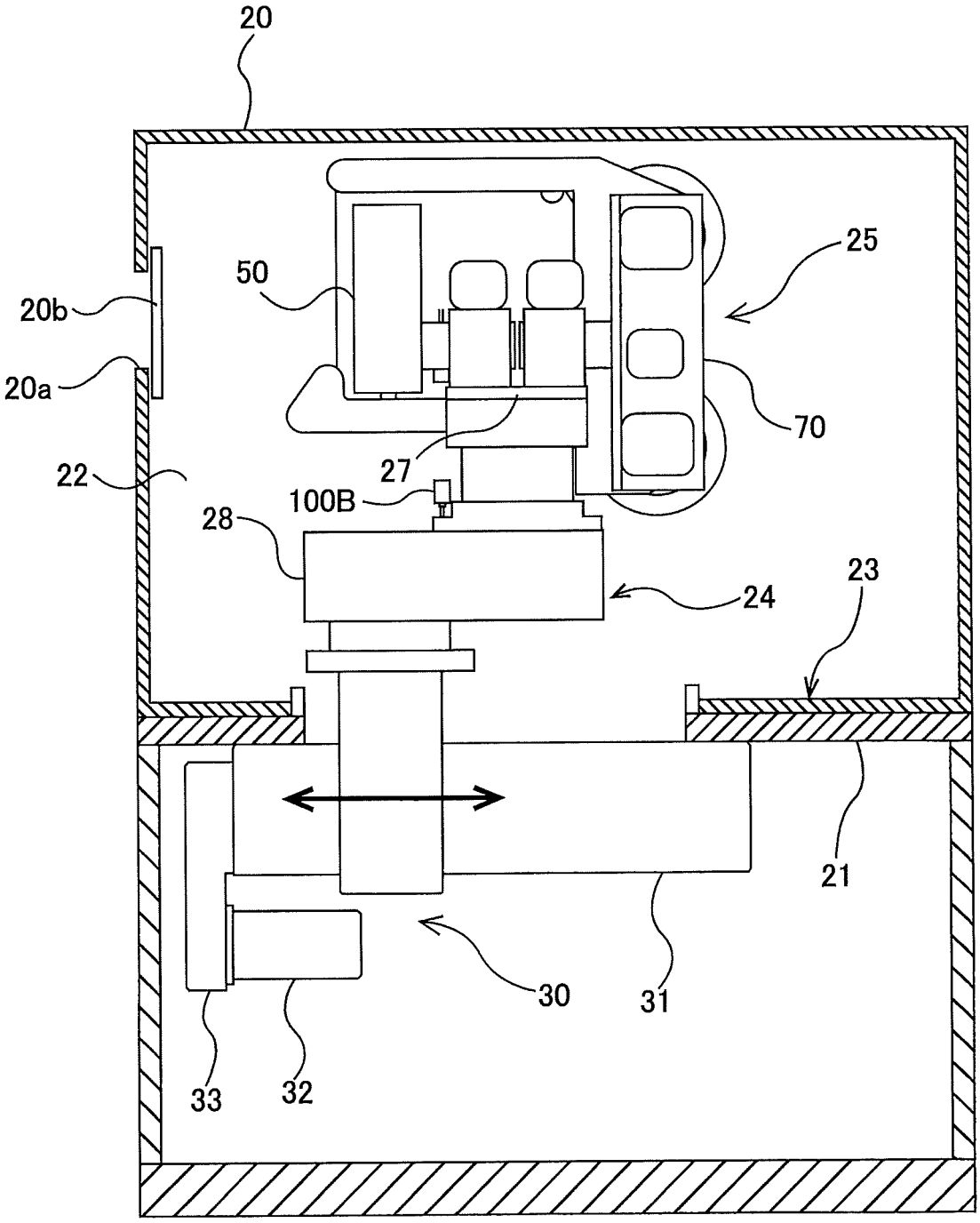
FIG. 22 is a view from a direction indicated by arrow G in FIG. 21.

As shown in FIG. 21, the partition wall 20 is fixed to a base plate 21. A lower part of the wafer rotating device 3 extends through both the bottom of the partition wall 20 and the base plate 21. In the present embodiment, a base structure 23 is constituted by the bottom of the partition wall 20 and the base plate 21. A support structure 24 supporting the polishing unit 2, including the polishing head 50 and the polishing-tape supply mechanism 70, is fixed to the base structure 23. The partition wall 20 has a transfer opening 20*a* that allows the wafer W to be carried into and out of the polishing chamber 22. The transfer opening 20*a* can be closed by a shutter 20*b*.

The hollow shaft 5 is supported by ball spline bearings (i.e., linear motion bearings) 6 which allow the hollow shaft 5 to move vertically. The groove 4*b* is formed in the wafer holding surface 4*a* of the holding stage 4. This groove 4*b* communicates with a communication passage 7 extending through the hollow shaft 5. The communication passage 7 is coupled to a vacuum line 9 via a rotary joint 8 provided on a lower end of the hollow shaft 5. The communication passage 7 is also coupled to a nitrogen-gas supply line 10 for use in releasing the wafer W from the holding stage 4 after processing of the wafer W. By selectively coupling the vacuum line 9 and the nitrogen-gas supply line 10 to the communication passage 7, the wafer W can be held on the wafer holding surface 4*a* of the holding stage 4 by the vacuum suction and can be released from the wafer holding surface 4*a*.

A pulley p1 is coupled to the hollow shaft 5, and a pulley p2 is mounted to a rotational shaft of the motor M1. The hollow shaft 5 is rotated by the motor M1 through the pulley p1, the pulley p2, and a belt b1 riding on these pulleys p1 and p2. The ball spline bearing 6 is a bearing that allows the hollow shaft 5 to move freely in its longitudinal direction. The ball spline bearings 6 are secured to a cylindrical casing 12. Therefore, the hollow shaft 5 can move linearly up and down relative to the casing 12, and the hollow shaft 5 and the casing 12 rotate together. The hollow shaft 5 is coupled to a pneumatic cylinder (elevating mechanism) 15, so that the hollow shaft 5 and the holding stage 4 are elevated and lowered by the pneumatic cylinder 15.

A cylindrical casing 14 is provided so as to surround the casing 12 in a coaxial arrangement. Radial bearings 18 are provided between the casing 12 and the casing 14, so that the casing 12 is rotatably supported by the radial bearings 18. With these structures, the wafer rotating device 3 can rotate the wafer W about the rotation axis CP and can elevate and lower the wafer W along the rotation axis CP.

The polishing unit 25 for polishing the edge portion of the wafer W is arranged outwardly of the wafer rotating device 3. This polishing unit 25 is located in the polishing chamber 22. As shown in FIG. 22, the polishing unit 25 in its entirety is secured to a mount base 27, which is coupled to a polishing-unit moving mechanism 30 via a support block 28. The polishing-unit moving mechanism 30 is fixed to the base plate 21.

The polishing-unit moving mechanism 30 has a ball screw mechanism 31 that slidably holds the support block 28, a motor 32 for driving the ball screw mechanism 31, and a power transmission mechanism 33 that couples the motor 32 to the ball screw mechanism 31. The ball screw mechanism 31 includes a linear motion guide (not shown) that guides the moving direction of the support block 28. The power transmission mechanism 33 is constructed by pulleys, a belt, and the like. When the motor 32 is in motion, the ball screw mechanism 31 moves the support block 28 in directions indicated by arrows in FIG. 22 to thereby move the polishing unit 25 in its entirety in a tangential direction of the wafer W. This polishing-unit moving mechanism 30 also serves as an oscillation mechanism for oscillating the polishing unit 25 at a predetermined amplitude and a predetermined speed. In the present embodiment, the polishing-unit moving mechanism 30 moves the polishing unit 25, including the polishing head 50 and the polishing-tape supply mechanism 70, in a first direction.

Figure 23:
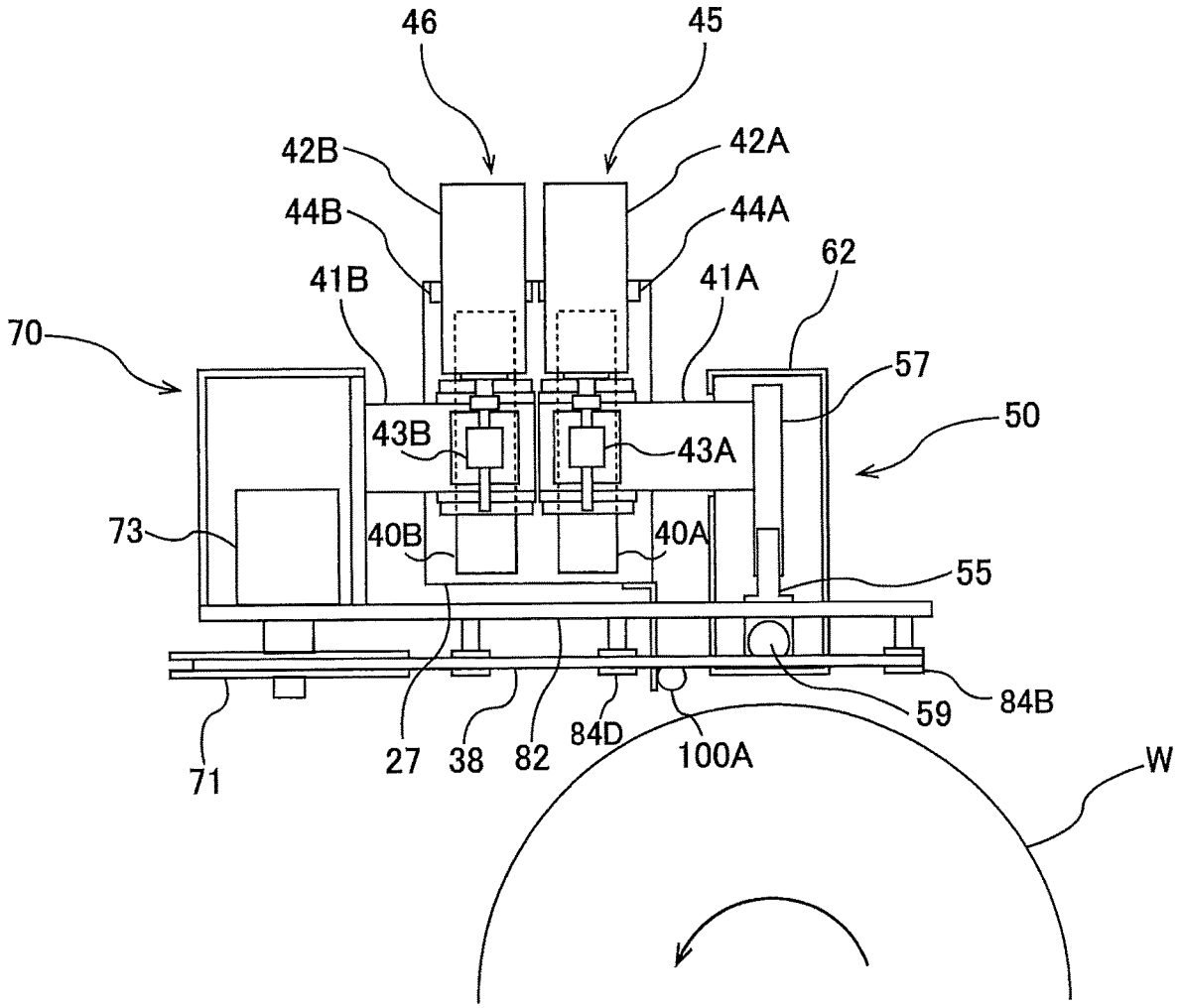
FIG. 23 is a plan view of a polishing head and a polishing-tape supply mechanism.
Figure 24:
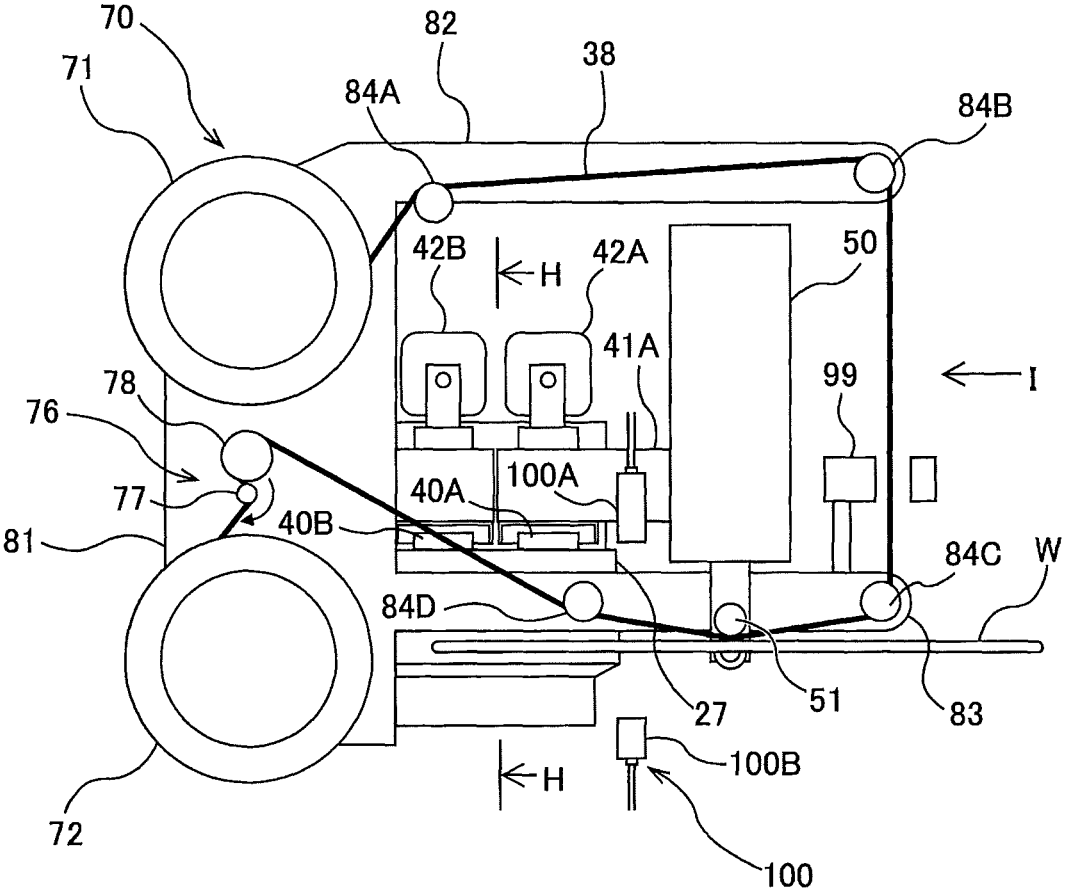
FIG. 24 is a front view of the polishing head and the polishing-tape supply mechanism when the polishing tape is pressed against the wafer.
Figure 25:
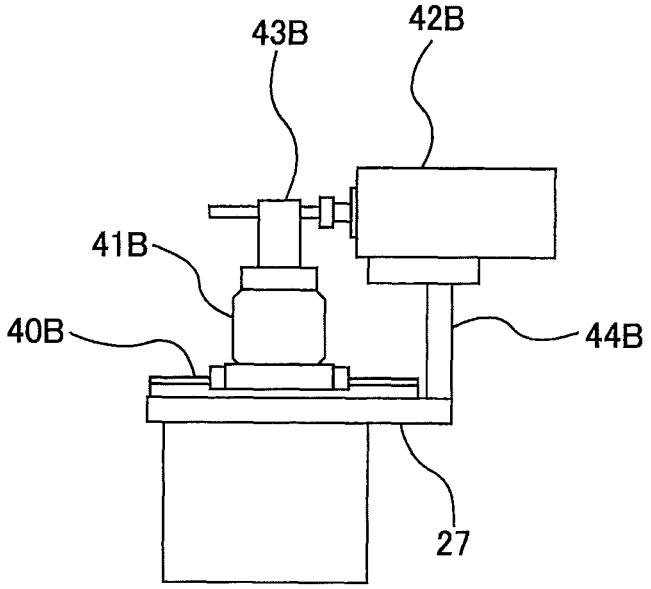
FIG. 25 is a cross-sectional view taken along line H-H shown in FIG. 24.
Figure 26:
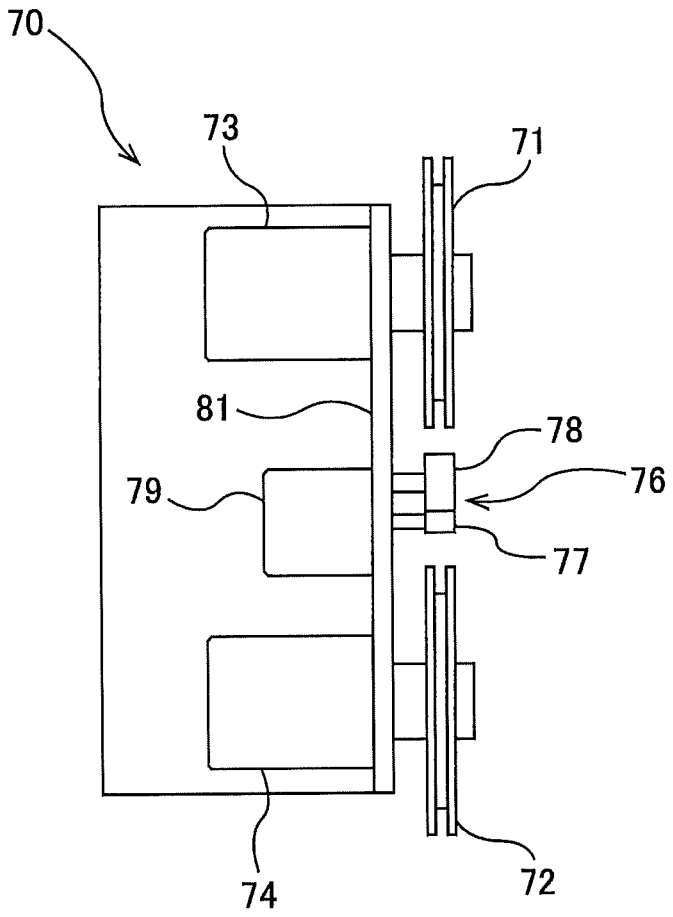
FIG. 26 is a side view of the polishing-tape supply mechanism shown in FIG. 24.
Figure 27:
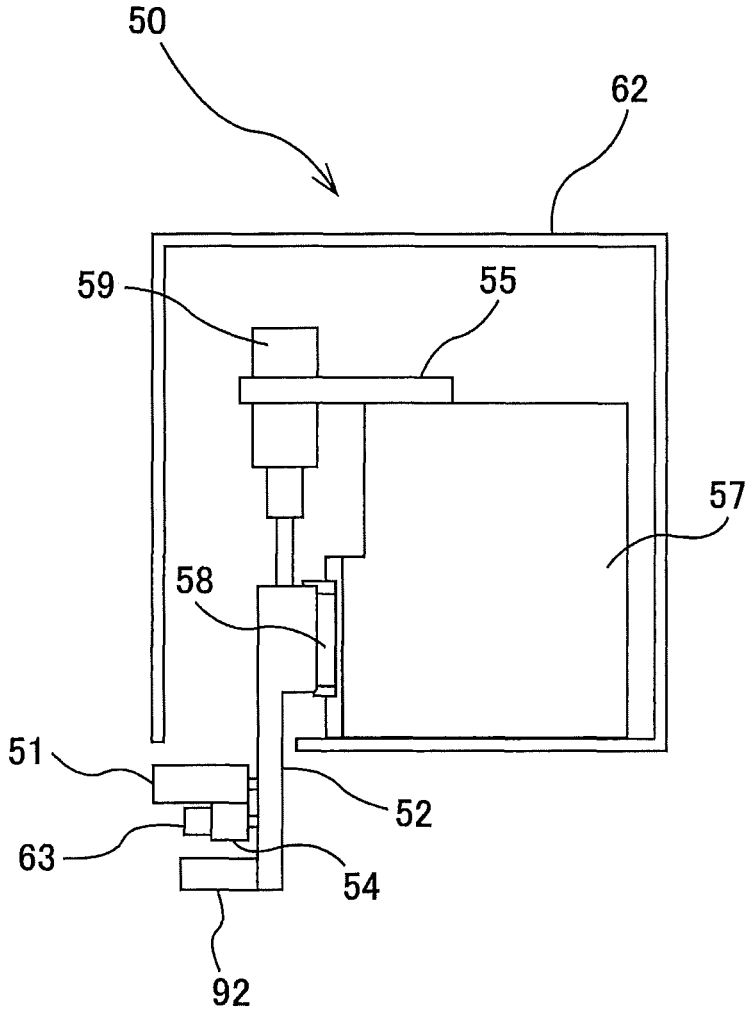
FIG. 27 is a vertical cross-sectional view of the polishing head shown in FIG. 24 as viewed from a direction indicated by arrow I.

FIG. 23 is a plan view of the polishing head 50 and the polishing-tape supply mechanism 70, FIG. 24 is a front view of the polishing head 50 and the polishing-tape supply mechanism 70 when the polishing tape 38 is pressed against the wafer W, FIG. 25 is a cross-sectional view taken along line H-H in FIG. 24, FIG. 26 is a side view of the polishing-tape supply mechanism 70 shown in FIG. 24, and FIG. 27 is a vertical cross-sectional view of the polishing head 50 as viewed from a direction indicated by arrow I in FIG. 24.

Two linear motion guides 40A and 40B, which extend parallel to the radial direction of the wafer W, are disposed on the mount base 27. These linear motion guides 40A and 40B are arranged in parallel to each other. The polishing head 50 and the linear motion guide 40A are coupled to each other via a coupling block 41A. Further, the polishing head 50 is coupled to a servomotor 42A and a ball screw mechanism 43A for moving the polishing head 50 along the linear motion guide 40A (i.e., in the radial direction of the wafer holding surface 4*a*). More specifically, the ball screw mechanism 43A is secured to the coupling block 41A, and the servomotor 42A is secured to the mount base 27 through a support member 44A. The servomotor 42A is configured to rotate a screw shaft of the ball screw mechanism 43A, so that the coupling block 41A and the polishing head 50 (which is coupled to the coupling block 41A) are moved along the linear motion guide 40A. In the present embodiment, the servomotor 42A, the ball screw mechanism 43A, and the linear motion guide 40A constitute the roller moving mechanism 45 for moving the polishing head 50 in a second direction perpendicular to the first direction.

The polishing-tape supply mechanism 70 and the linear motion guide 40B are coupled to each other via a coupling block 41B. Further, the polishing-tape supply mechanism 70 is coupled to a servomotor 42B and a ball screw mechanism 43B for moving the polishing-tape supply mechanism 70 along the linear motion guide 40B (i.e., in the radial direction of the wafer holding surface 4*a*). More specifically, the ball screw mechanism 43B is secured to the coupling block 41B, and the servomotor 42B is secured to the mount base 27 through a support member 44B. The servomotor 42B is configured to rotate a screw shaft of the ball screw mechanism 43B, so that the coupling block 41B and the polishing-tape supply mechanism 70 (which is coupled to the coupling block 41B) are moved along the linear motion guide 40B. The servomotor 42B, the ball screw mechanism 43B, and the linear motion guide 40B constitute the polishing-tape moving mechanism 46 for moving the polishing-tape supply mechanism 70 in the radial direction of the wafer holding surface 4*a*.

As shown in FIG. 27, the polishing head 50 has the first roller 51 for pressing the polishing tape 38 against the wafer W, the second roller 54 functioning as a positioning member for the polishing tape 38, the third roller 63 located below the first roller 51, the roller support member 52 supporting the first roller 51, the second roller 54, and the third roller 63, and the roller actuator 59 as a pressing device configured to move up and down the roller support member 52, the first roller 51, the second roller 54, and the third roller 63. The roller actuator 59 is held by a holding member 55, which is fixed to a mounting member 57 fixed to the coupling block 41A. The polishing pressure at which the first roller 51 presses the polishing tape 38 against the wafer W is generated by the roller actuator 59.

The roller support member 52 is coupled to the mounting member 57 through a linear motion guide 58 extending perpendicularly to the wafer holding surface 4*a*. When the roller support member 52 is pushed down by the roller actuator 59, the first roller 51, the second roller 54, and the third roller 63 move downward along the linear motion guide 58, and the first roller 51 presses the polishing tape 38 against the edge portion of the wafer W. Furthermore, the roller actuator 59 can elevate the roller support member 52, the first roller 51, the second roller 54, and the third roller 63 along the linear motion guide 58. In the present embodiment, the distance sensor 92 is coupled to the roller support member 52, so that the distance sensor 92 moves up and down together with the first roller 51, the second roller 54, and the third roller 63.

The upper part of the roller support member 52, the roller actuator 59, the holding member 55, and the mounting member 57 are located in a box 62. The lower part of the roller support member 52 protrudes from the bottom of the box 62. The first roller 51, the second roller 54, and the third roller 63 are supported by the lower part of the roller support member 52.

As shown in FIG. 26, the polishing-tape supply mechanism 70 includes the feeding reel 71 for supplying the polishing tape 38 to the polishing head 50, and the take-up reel 72 for taking up the polishing tape 38 from the polishing head 50. The feeding reel 71 and the take-up reel 72 are coupled to a tension motor 73 and a tension motor 74, respectively. These tension motors 73, 74 can exert a predetermined tension on the polishing tape 38 by applying predetermined torques to the feeding reel 71 and the take-up reel 72.

The tape advancing mechanism 76 is provided between the feeding reel 71 and the take-up reel 72. The tape advancing mechanism 76 includes the tape advancing roller 77 for advancing the polishing tape 38, the nip roller 78 for pressing the polishing tape 38 against the tape advancing roller 77, and the tape advancing motor 79 for rotating the tape advancing roller 77. The polishing tape 38 is sandwiched between the nip roller 78 and the tape advancing roller 77. When the tape advancing motor 79 rotates the tape advancing roller 77 in the direction indicated by arrow in FIG. 24, the polishing tape 38 is advanced from the feeding reel 71 to the take-up reel 72.

The tension motors 73, 74 and the tape advancing motor 79 are secured to the base 81. The base 81 is fixed to the coupling block 41B. The base 81 includes two support arms 82, 83 extending from the feeding reel 71 and the take-up reel 72 toward the polishing head 50. A plurality of guide rollers 84A, 84B, 84C, 84D for supporting the polishing tape 38 are attached to the support arms 82, 83. The polishing tape 38 is guided by these guide rollers 84A, 84B, 84C, 84D such that the polishing tape 38 surrounds the polishing head 50.

The extending direction of the polishing tape 38 is perpendicular to the radial direction of the wafer W when viewed from the above. The polishing tape 38 extending between the two guide rollers 84C, 84D, which are located below the polishing head 50, extends parallel to the tangential direction of the wafer W. In the present embodiment, the tape-width measuring sensor 99 is secured to the support arm 83. In one embodiment, the tape-width measuring sensor 99 may be secured to the support arm 82.

The polishing apparatus further includes a tape-edge detection sensor 100 configured to detect the position of the edge of the polishing tape 38. The tape-edge detection sensor 100 is a transmission optical sensor. The tape-edge detection sensor 100 has a light emitting device 100A and a light receiving device 100B. The light emitting device 100A is fixed to the mount base 27 as shown in FIG. 23, and the light receiving device 100B is fixed to the base plate 21 as shown in FIG. 21. The tape-edge detection sensor 100 is configured to detect the position of the edge of the polishing tape 38 from the amount of light received by the light receiving device 100B.

Figure 28:
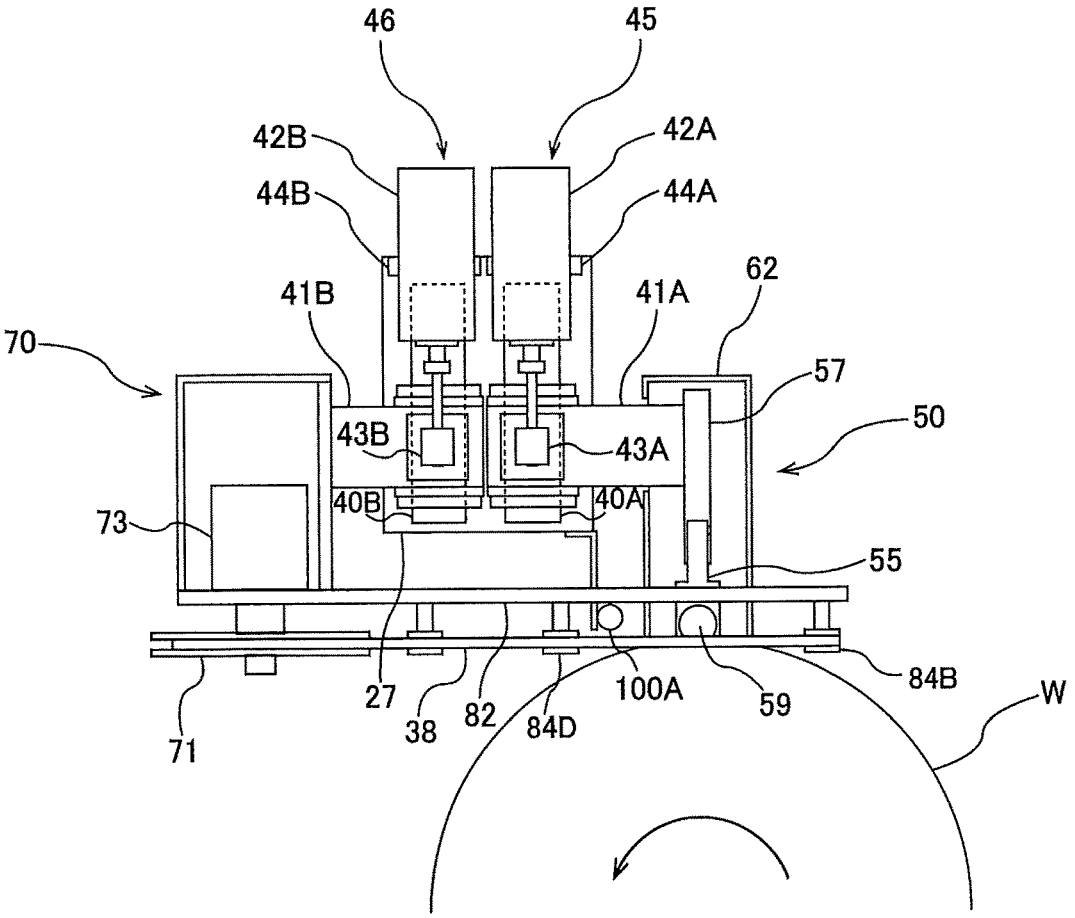
FIG. 28 is a plan view of the polishing head and the polishing-tape supply mechanism in respective polishing positions.
Figure 29:
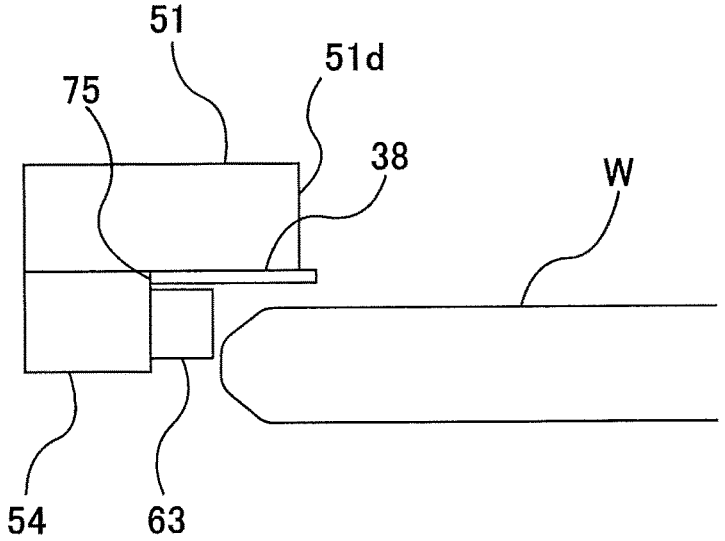
FIG. 29 is a schematic view of the first roller in the polishing position, the polishing tape, and the wafer as viewed from a lateral direction.

As shown in FIG. 28, when the wafer W is to be polished, the polishing head 50 and the polishing-tape supply mechanism 70 are moved by the roller moving mechanism 45 and the polishing-tape moving mechanism 46, respectively, to their predetermined polishing positions. The polishing tape 38 in the polishing position extends in the tangential direction of the wafer W. FIG. 29 is a schematic view of the first roller 51, the second roller 54, the third roller 63, the polishing tape 38, and the wafer W in their polishing positions, as viewed from a lateral direction. As shown in FIG. 29, the polishing tape 38 is located above the edge portion of the wafer W. The first roller 51, the second roller 54, and the third roller 63 are moved toward the polishing tape 38 until the outer edge of the polishing tape 38 contacts the tape stopper surface 75 of the second roller 54.

Figure 30:
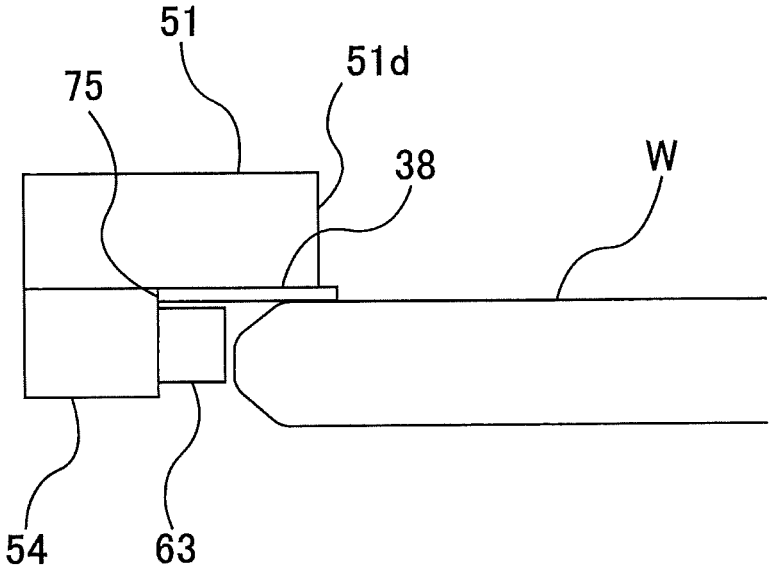
FIG. 30 is a view showing a state in which the polishing tape is pressed against the edge portion of the wafer by the first roller.
Figure 31:
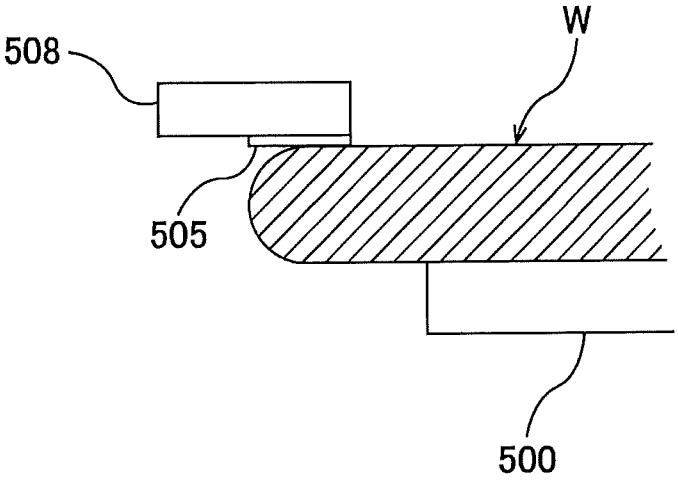
FIG. 31 is a view showing a conventional polishing apparatus.
Figure 32:
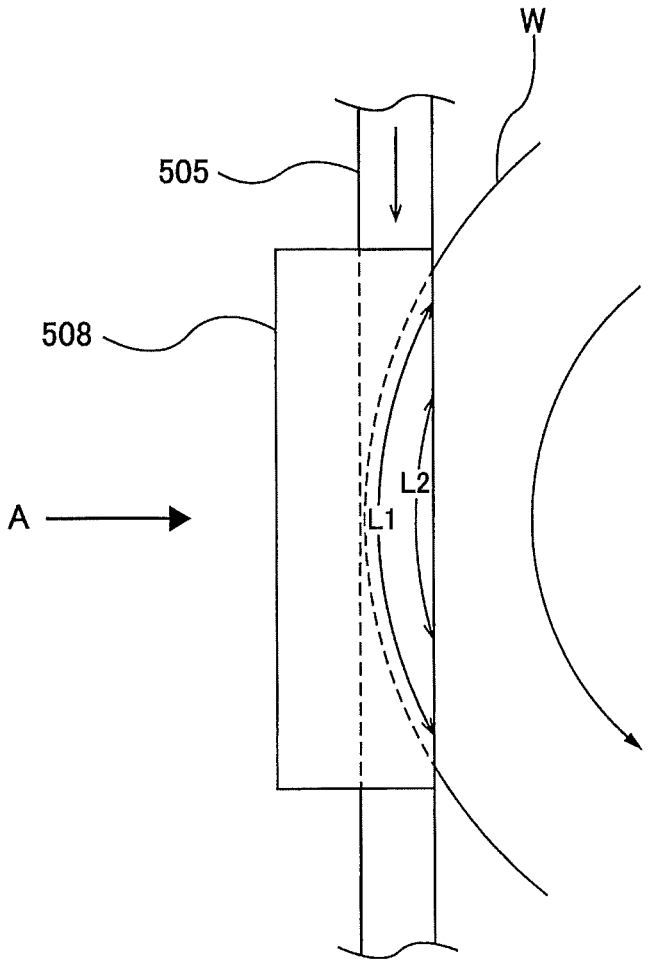
FIG. 32 is a top view of the polishing apparatus shown in FIG. 31.
Figure 33:
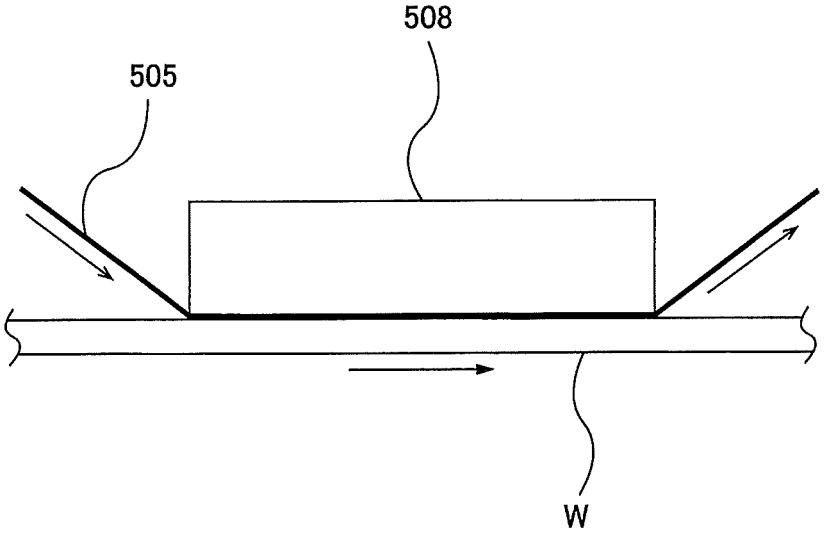
FIG. 33 is a view from a direction indicated by arrow A in FIG. 32.

FIG. 30 is a view showing a state in which the polishing tape 38 is pressed against the edge portion of the wafer W by the first roller 51. In the present embodiment, the inner edge of the polishing tape 38 protrudes slightly from the inner end surface 51*d* of the first roller 51. In one embodiment, the inner edge of the polishing tape 38 may coincide with the inner end surface 51*d* of the first roller 51.

Next, the polishing operation of the polishing apparatus will be described. The operation of the polishing apparatus described below is controlled by the arithmetic device 95 (see FIG. 20) constituted by a general-purpose computer or a dedicated computer. The wafer W is held by the wafer rotating device 3 so that a film (for example, a device layer) formed on the surface of the wafer W faces upward. The wafer W is then rotated about the rotation axis CP. The liquid (for example, pure water) is supplied to the center of the rotating wafer W from the liquid supply nozzle (not shown). The first roller 51, the second roller 54, the third roller 63, and the polishing tape 38 are moved to the predetermined polishing positions respectively as shown in FIG. 29.

Next, the roller actuator 59 (see FIG. 27) pushes down the first roller 51, the second roller 54, and the third roller 63, so that the first roller 51 presses the polishing tape 38 against the edge portion of the wafer W with a predetermined polishing pressure as shown in FIG. 30. The polishing pressure can be regulated by the pressure of the gas supplied to the pneumatic cylinder constituting the roller actuator 59. The sliding contact between the rotating wafer W and the polishing tape 38 polishes the edge portion of the wafer W. As a result, the polishing tape 38 can form a step-shaped recess 510 having a right-angled cross section as shown in FIG. 34.

In order to increase the polishing rate of the wafer W, the polishing-unit moving mechanism 30 may cause the polishing tape 38 to oscillate in the tangential direction of the wafer W during the polishing of the wafer W. During polishing of the wafer W, the liquid (for example, pure water) is supplied to the central portion of the rotating wafer W, and the wafer W is polished in the presence of the liquid. The liquid that has been supplied to the wafer W spreads over the entirety of the upper surface of the wafer W by centrifugal force, thus preventing polishing debris from adhering to devices forming on the wafer W.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus for forming a step-shaped recess in an edge portion of a substrate, comprising:

a substrate rotating device configured to rotate the substrate about a rotation axis; a first rotatable roller having a first circumferential surface configured to press a polishing tape against the edge portion of the substrate; and a second rotatable roller having a second circumferential surface in contact with the first circumferential surface, the second rotatable roller having a tape stopper surface that restricts movement of the polishing tape in a direction away from the rotation axis, the tape stopper surface being located radially outward of the first circumferential surface.

2. The polishing apparatus according to claim 1, wherein the first rotatable roller and the second rotatable roller are rotatable about a first axis and a second axis, respectively, extending toward the rotation axis.

3. The polishing apparatus according to claim 1, further comprising a third roller concentrically fixed to the second rotatable roller, the third roller having a third circumferential surface with a diameter smaller than a diameter of the second circumferential surface, the tape stopper surface being connected to the third circumferential surface.

4. The polishing apparatus according to claim 3, wherein an axial length of the third roller is smaller than a distance between an inner end surface of the first rotatable roller and the tape stopper surface.

5. The polishing apparatus according to claim 1, wherein a distance between an inner end surface of the first rotatable roller and the tape stopper surface is equal to or smaller than a width of the polishing tape.

6. The polishing apparatus according to claim 1, further comprising a tape-stopper-surface detection system configured to detect a position of the tape stopper surface.

7. The polishing apparatus according to claim 6, wherein the tape-stopper-surface detection system is configured to emit an alarm when an amount of change in the position of the tape stopper surface exceeds a preset threshold value.

8. The polishing apparatus according to claim 6, further comprising: a roller moving mechanism configured to move the first rotatable roller and the second rotatable roller in a direction toward the rotation axis and in a direction away from the rotation axis, wherein the tape-stopper-surface detection system is configured to instruct the roller moving mechanism to move the first rotatable roller and the second rotatable roller toward the rotation axis by a distance corresponding to the amount of change in the position of the tape stopper surface.

9. The polishing apparatus according to claim 1, further comprising: a roller moving mechanism configured to move the first rotatable roller and the second rotatable roller in a direction toward the rotation axis and in a direction away from the rotation axis; a tape-width measuring sensor configured to measure a width of the polishing tape; and an arithmetic device configured to instruct the roller moving mechanism to move the first rotatable roller and the second rotatable roller in a direction as to cancel a change in a measured width of the polishing tape.

10. A polishing method of forming a step-shaped recess in an edge portion of a substrate, comprising:

rotating the substrate about a rotation axis; and pressing a polishing tape against the edge portion of the substrate by a first circumferential surface of a first rotating roller while restricting movement of the polishing tape in a direction away from the rotation axis by a tape stopper surface of a second rotating roller, the second rotating roller having a second circumferential surface in contact with the first circumferential surface, the tape stopper surface being located radially outward of the first circumferential surface.

11. The polishing method according to claim 10, further comprising emitting an alarm when an amount of change in a position of the tape stopper surface exceeds a preset threshold value.

12. The polishing method according to claim 10, further comprising moving the first rotating roller and the second rotating roller toward the rotation axis by a distance corresponding to an amount of change in a position of the tape stopper surface.

13. The polishing method according to claim 10, further comprising: measuring a width of the polishing tape; and moving the first rotating roller and the second rotating roller in a direction as to cancel a change in a measured width of the polishing tape.

* * * * *